US007948400B2

(12) United States Patent
Horvitz et al.

(10) Patent No.: US 7,948,400 B2
(45) Date of Patent: May 24, 2011

(54) PREDICTIVE MODELS OF ROAD RELIABILITY FOR TRAFFIC SENSOR CONFIGURATION AND ROUTING

(75) Inventors: Eric J. Horvitz, Kirkland, WA (US); Sridhar Srinivasan, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 576 days.

(21) Appl. No.: 11/771,205

(22) Filed: Jun. 29, 2007

(65) Prior Publication Data

US 2009/0002195 A1 Jan. 1, 2009

(51) Int. Cl.
*G08G 1/065* (2006.01)

(52) U.S. Cl. ..... 340/934; 340/933; 701/117; 701/118

(58) Field of Classification Search ..... 340/933, 340/934; 701/117, 118

See application file for complete search history.

(56) References Cited

U.S. PATENT DOCUMENTS

| | | | | |
|---|---|---|---|---|
| 5,173,691 | A * | 12/1992 | Sumner | 340/905 |
| 5,493,692 | A | 2/1996 | Theimer et al. | |
| 5,544,321 | A | 8/1996 | Theimer et al. | |
| 5,555,376 | A | 9/1996 | Theimer et al. | |
| 5,603,054 | A | 2/1997 | Theimer et al. | |
| 5,611,050 | A | 3/1997 | Theimer et al. | |
| 5,812,865 | A | 9/1998 | Theimer et al. | |
| 6,256,577 | B1 * | 7/2001 | Graunke | 701/117 |
| 6,353,398 | B1 | 3/2002 | Amin et al. | |
| 6,466,232 | B1 | 10/2002 | Newell et al. | |
| 6,513,046 | B1 | 1/2003 | Abbott, III et al. | |
| 6,549,915 | B2 | 4/2003 | Abbott, III et al. | |
| 6,615,133 | B2 * | 9/2003 | Boies et al. | 701/209 |
| 6,672,506 | B2 | 1/2004 | Swartz et al. | |
| 6,741,188 | B1 | 5/2004 | Miller et al. | |
| 6,747,675 | B1 | 6/2004 | Abbott et al. | |
| D494,584 | S | 8/2004 | Schlieffers et al. | |
| 6,785,606 | B2 * | 8/2004 | DeKock et al. | 701/117 |
| 6,791,580 | B1 | 9/2004 | Abbott et al. | |

(Continued)

FOREIGN PATENT DOCUMENTS

EP 09620004 B1 5/2003

(Continued)

OTHER PUBLICATIONS

Andy Harter, et al., A Distributed Location System for the Active Office, IEEE Network, 1994, pp. 62-70.

(Continued)

*Primary Examiner* — George A Bugg
*Assistant Examiner* — Kerri McNally
(74) *Attorney, Agent, or Firm* — Wolf, Greenfield & Sacks, P.C.

(57) ABSTRACT

Methods for decision making about sensor location/configuration for traffic sensing and routing are described. Construction of predictive models via machine learning that infer variance of road speeds, in general or for specific contexts (e.g., rush hours for a traffic system) occurs. The predictive models for road reliability are built from libraries of data about sensed variances and road segments. The datasets include information for road segments monitored by fixed sensors/moving probes, road segment properties, geometric relationships among road segments, and proximal resources. Road segments are labeled by the sensed variance seen in traffic speeds over similar contexts. A model is created that can apply estimates of the variance of the traffic speed for a segment, including non-sensed segments via generalization to non-sensed road segments. Methods are described for employing the predictive models of variance, along with demand and propagation models, to make decisions about configuration of sensors.

20 Claims, 20 Drawing Sheets

U.S. PATENT DOCUMENTS

| | | | | |
|---|---|---|---|---|
| 6,796,505 | B2 | 9/2004 | Pellaumail et al. | |
| 6,801,223 | B1 | 10/2004 | Abbott et al. | |
| 6,812,937 | B1 | 11/2004 | Abbott et al. | |
| 6,837,436 | B2 | 1/2005 | Swartz et al. | |
| 6,842,877 | B2 | 1/2005 | Robarts et al. | |
| 7,010,501 | B1 | 3/2006 | Roslak et al. | |
| 7,040,541 | B2 | 5/2006 | Swartz et al. | |
| 7,063,263 | B2 | 6/2006 | Swartz et al. | |
| 7,171,378 | B2 | 1/2007 | Petrovich et al. | |
| 7,195,157 | B2 | 3/2007 | Swartz et al. | |
| 7,302,369 | B2 * | 11/2007 | Wren | 703/2 |
| 7,385,501 | B2 | 6/2008 | Miller et al. | |
| 2001/0030664 | A1 | 10/2001 | Shulman et al. | |
| 2001/0040590 | A1 | 11/2001 | Abbott et al. | |
| 2001/0040591 | A1 | 11/2001 | Abbott et al. | |
| 2001/0043231 | A1 | 11/2001 | Abbott et al. | |
| 2001/0043232 | A1 | 11/2001 | Abbott et al. | |
| 2002/0032689 | A1 | 3/2002 | Abbott, III et al. | |
| 2002/0044152 | A1 | 4/2002 | Abbott, III et al. | |
| 2002/0052930 | A1 | 5/2002 | Abbott et al. | |
| 2002/0052963 | A1 | 5/2002 | Abbott et al. | |
| 2002/0054130 | A1 | 5/2002 | Abbott, III et al. | |
| 2002/0054174 | A1 | 5/2002 | Abbott et al. | |
| 2002/0078204 | A1 | 6/2002 | Newell et al. | |
| 2002/0080155 | A1 | 6/2002 | Abbott et al. | |
| 2002/0080156 | A1 | 6/2002 | Abbott et al. | |
| 2002/0083025 | A1 | 6/2002 | Robarts et al. | |
| 2002/0083158 | A1 | 6/2002 | Abbott et al. | |
| 2002/0087525 | A1 | 7/2002 | Abbott et al. | |
| 2002/0099817 | A1 | 7/2002 | Abbott et al. | |
| 2003/0046401 | A1 | 3/2003 | Abbott et al. | |
| 2003/0154476 | A1 | 8/2003 | Abbott, III et al. | |
| 2004/0201500 | A1 | 10/2004 | Miller et al. | |
| 2005/0034078 | A1 | 2/2005 | Abbott et al. | |
| 2005/0266858 | A1 | 12/2005 | Miller et al. | |
| 2005/0272442 | A1 | 12/2005 | Miller et al. | |
| 2006/0019676 | A1 | 1/2006 | Miller et al. | |
| 2006/0064234 | A1 * | 3/2006 | Kumagai et al. | 701/117 |
| 2008/0090591 | A1 | 4/2008 | Miller et al. | |
| 2008/0091537 | A1 | 4/2008 | Miller et al. | |
| 2008/0161018 | A1 | 7/2008 | Miller et al. | |
| 2008/0303693 | A1 * | 12/2008 | Link, II | 340/905 |

FOREIGN PATENT DOCUMENTS

| | | | |
|---|---|---|---|
| KR | 10-2001-0016528 | A | 3/2001 |
| KR | 10-2002-0065659 | A | 8/2002 |
| WO | 9800787 | | 1/1998 |

OTHER PUBLICATIONS

Guanling Chen, et al., A Survey of Context-Aware Mobile Computing Research, Dartmouth Computer Science Technical Report, 2000, 16 pages.
William Noah Schilt, A System Architecture for Context-Aware Mobile Computing, Columbia University, 1995, 153 pages.
Mike Spreitzer, et al., Providing Location Information in a Ubiquitous Computing Environment, SIGOPS '93, 1993, pp. 270-283.
Marvin Theimer, et al., Operating System Issues for PDAs, In Fourth Workshop on Workstation Operating Systems, 1993, 7 pages.
Roy Want, Active Badges and Personal Interactive Computing Objects, IEEE Transactions on Consumer Electronics, 1992, 11 pages, vol. 38—No. 1.
Bill N. Schilit, et al., The ParcTab Mobile Computing System, IEEE WWOS-IV, 1993, 4 pages.
Bill Schilit, et al., Context-Aware Computing Applications, In Proceedings of the Workshop on Mobile Computing Systems and Applications, Dec. 1994. pp. 85-90.
Bill N. Schilit, et al., Customizing Mobile Applications, Proceedings USENIX Symposium on Mobile and Location Independent Computing, Aug. 1993, 9 pages.
Mike Spreitzer, et al., Architectural Considerations for Scalable, Secure, Mobile Computing with Location Information, In The 14th International Conference on Distributed Computing Systems, Jun. 1994, pp. 29-38.
Mike Spreitzer et al., Scalable, Secure, Mobile Computing with Location Information, Communications of the ACM, Jul. 1993, 1 page, vol. 36—No. 7.
Roy Want, et al., The Active Badge Location System, ACM Transactions on Information Systems, Jan. 1992, pp. 91-102, vol. 10—No. 1.
Mark Weiser, Some Computer Science Issues in Ubiquitous Computing, Communications of the ACM, Jul. 1993, pp. 75-84, vol. 36—No. 7.
M. Billinghurst, et al., An Evaluation of Wearable Information Spaces, Proceedings of the Virtual Reality Annual International Symposium, 1998, 8 pages.
Bradley J. Rhodes, Remembrance Agent: A continuously running automated information retrieval system, The Proceedings of The First International Conference on The Practical Application Of Intelligent Agents and Multi Agent Technology, 1996, pp. 487-495.
Eric Horvitz, et al., In Pursuit of Effective Handsfree Decision Support: Coupling Bayesian Inference, Speech Understanding, and User Models, 1995, 8 pages.
Bradley J. Rhodes, The Wearable Remembrance Agent: A System for Augmented Theory, The Proceedings of The First International Symposium on Wearable Computers, Oct. 1997, pp. 123-128.
Eric Horvitz, et al., Attention-Sensitive Alerting in Computing Systems, Microsoft Research, Aug. 1999.
Bill N. Schilit, et al., Disseminationg Active Map Information to Mobile Hosts, IEEE Network, 1994, pp. 22-32, vol. 8—No. 5.
Mark Billinghurst, et al., Wearable Devices: New Ways to Manage Information, IEEE Computer Society, Jan. 1999, pp. 57-64.
Thad Eugene Starner, Wearable Computing and Contextual Awareness, Massachusetts Institute of Technology, Jun. 1999, 248 pages.
Bradley J. Rhodes, The Wearable Remembrance Agent: A System for Augmented Memory, Personal Technologies Journal Special Issue on Wearable Computing, 1997, 12 pages.
Workshop on Wearable Computing Systems, Aug. 19-21, 1996.
Mark Billinghurst, Research Directions in Wearable Computing, University of Washington, May, 1998, 48 pages.
Mark Weiser, The Computer for the 21st Century, Scientific American, Sep. 1991, 8 pages.
T. Joachims, Text categorization with support vector machines: learning with many relevant features, Machine Learning, European Conference on Machine Learning, Apr. 21, 1998, pp. 137-142.
International Search Report dated Sep. 29, 2003 for PCT Application Serial No. 00/20685, 3 Pages.
Robert M. Losee, Jr., Minimizing information overload: the ranking of electronic messages, Journal of Information Science 15, Elsevier Science Publishers B.V., 1989, pp. 179-189.

* cited by examiner

PREDICTIVE MODELS OF ROAD RELIABILITY FOR TRAFFIC SENSOR CONFIGURATION AND ROUTING

CROSS-REFERENCE

This application relates to U.S. patent application Ser. No. 11/428,175 entitled "INFERRING ROAD SPEEDS FOR CONTEXT-SENSITIVE ROUTING" filed on Jun. 30, 2006. The entirety of which is herein incorporated by reference.

BACKGROUND

Computer-driven systems utilize sets of sensors to monitor arterial flow systems. In general, arterial flow systems describe the movement of liquids, gases or granular materials through pipes, conveyors or other conduits. Movement of traffic through streets of a city or geographic region can also be viewed as an arterial system. The flow of automobiles and other vehicles through a city can be tracked using various types or sets of sensors. The collected sensor data can be utilized by a traffic flow system to monitor movement of traffic.

Traffic flow systems can be utilized for a variety of purposes including route planning and road design. For example, flow of traffic can be monitored to detect and predict bottleneck situations. Identification of bottlenecks in an arterial flow system, such as a traffic system, allows for diversion of materials and alleviation of the bottleneck. In addition, identification of road segments prone to bottlenecks can assist in planning future traffic flow or modifying existing roadways (e.g., expanding an existing two-lane road into a four-lane road).

Traffic flow can be monitored utilizing a variety of sensors. In particular, during rush hours, when most commuters are in transit between work and home, traffic in most major cities is monitored using helicopters, strategically positioned cameras and/or commuter reports of traffic incidents. In addition, particularly well-traveled roads can include networks of pressure sensors designed to monitor the flow of traffic. Commuters can be provided with traffic information necessary to plan a commute route via traffic reports broadcast over the radio or on their televisions. Traffic information can also be displayed via electronic signs alerting travelers approaching an interchange or other problem area. Such signs can even include a prediction of travel time based upon the density and speed of traffic detected by the sensors. The provided traffic information allows drivers to plan their commute to avoid bottlenecks and minimize travel time.

Validity of the traffic flow information and systems that monitor or predict the traffic flow are generally dependent upon both availability and accuracy of data received from sensors. In general, large sets of sensors are used to estimate or compute current flow of a system and to predict future flow. Positioning of sensors can greatly affect accuracy of traffic monitoring or predicting systems. For example, detection of a bottleneck can be dependent upon availability of sensor data from locations proximate to probable bottleneck locations (e.g., interchanges, constructions locations and the like). Placement of sensor or availability of accurate sensor data for key junctions can be crucial to accuracy of flow prediction.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its sole purpose is to present some concepts in a simplified form as a prelude to the more detailed description that is presented later.

Computer-driven route planning applications and other flow systems are utilized every day to aid users in traffic planning, commute planning and the like. These flow systems are oftentimes dependent upon data received from a set of sensors. The systems can utilize information obtained using a variety of sensor methods including fixed or stationary sensors (e.g., pressure sensors and video cameras), sensors coupled to vehicles moving with the traffic flow (e.g., GPS) and traffic reports or any other indicators of flow. Availability of sensor data can vary in utility depending upon the location at which the data is collected, the context or conditions under which it is collected and the like. Sensor data from key locations within the flow system (e.g., heavily used interchanges, construction sites and the like) can greatly influence the effectiveness of the flow monitoring system.

This specification, in one aspect thereof, discloses determining relative value of sensor data for a flow system. Values indicative of utility of sensor data collected within a section or region can be associated with particular sections within the flow system. Utility values can be based upon usefulness of data in identifying or predicting heavy congestion or bottlenecks with the system. The utility values can be associated with sensor data collected within a section. Alternatively, values can be associated with specific sensors. In addition, the conditions or the context under which data is collected as well as type of sensor can affect relative utility value associated with sensor data. Association of utility value with sensor data allows for identification of critical sensors or sections within the flow system.

Identification of critical sensor data can be used to prioritize or filter sensor data for transmission to other systems (e.g., a route planning system). Prioritization or filtration is particularly useful when there is limited connectivity between systems. For example, a user may carry a mobile device that includes a route planning system. Large amounts of sensor data can be collected that have little or no effect upon the user's route. In situations where a route planning system is capable of processing only a limited subset of the sensor data due to limited connectivity, bandwidth, processing capabilities or any other limitations, most relevant information can be selected for transmission to the route planning system as a function of relative utility value of sensor data.

Identification of key sensor data or sections can also be utilized in design of traffic flow systems. Stationary or fixed sensors can be positioned based upon utility values associated with specific locations within the flow system. In addition, selection of sources of sensor data can be based upon the relative utility of sensor data received from different types of sources. Utility values can also be employed to analyze received sensor data and prioritize maintenance and/or upgrades.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed matter is intended to include all such aspects and their equivalents. Other advantages and novel features may become apparent from the following detailed description when considered in conjunction with the drawings.

DETAILED DESCRIPTION

Figure 1:
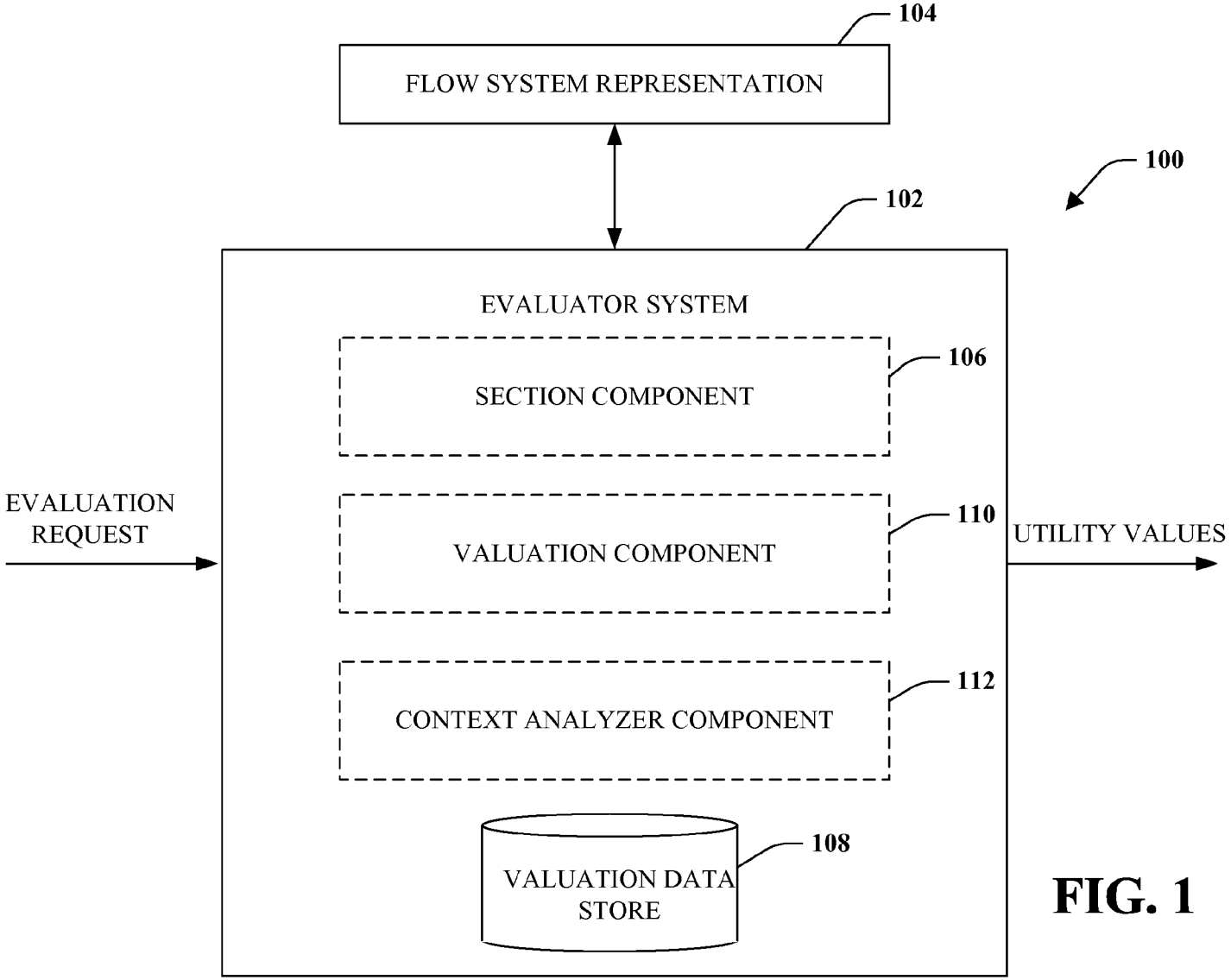
FIG. 1 is a block diagram of a system for generating utility values for sensor data and/or flow system segments in accordance with the subject matter described herein.

The subject invention is now described with reference to the drawings, wherein like reference numerals are used to refer to like elements throughout. In the following description, for purposes of explanation, numerous specific details are set forth in order to provide a thorough understanding of the claimed subject matter. It may be evident, however, that such subject matter may be practiced without these specific details. In other instances, well-known structures and devices are shown in block diagram form in order to facilitate describing the subject invention.

As used in this application, the terms "component" and "system" are intended to refer to a computer-related entity, either hardware, a combination of hardware and software, software, or software in execution. For example, a component may be, but is not limited to being, a process running on a processor, a processor, an object, an executable, a thread of execution, a program, and a computer. By way of illustration, both an application running on a server and the server can be a component. One or more components may reside within a process and/or thread of execution and a component may be localized on one computer and/or distributed between two or more computers. The word "exemplary" is used herein to mean serving as an example, instance, or illustration. Any aspect or design described herein as "exemplary" is not necessarily to be construed as preferred or advantageous over other aspects or designs.

Furthermore, aspects of the claimed subject matter may be implemented as a method, apparatus, or article of manufacture using standard programming and/or engineering techniques to produce software, firmware, hardware, or any combination thereof to control a computer to implement various aspects of the subject invention. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips, . . . ), optical disks (e.g., compact disk (CD), digital versatile disk (DVD), . . . ), smart cards, and flash memory devices (e.g., card, stick, key drive, . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope or spirit of what is described herein.

For purposes of explanation and not limitation, the systems and/or methods are generally described herein with respect to users traveling in a traffic system (e.g., in automobiles). However, it is to be understood and appreciated that concepts underlying the following description can be applied to other areas where value of information is important, such as bus lines, airport security, cooking (e.g., multi-tasking by trying to make several dishes using limited resources) and other similar areas. Therefore, the following description is not intended to be limited to the field of traffic.

Referring now to FIG. 1, a system 100 for valuation of flow system information is illustrated. The system 100 includes an evaluator system 102 that determines utility of data for a flow system as represented by the flow system representation 104. In addition, the evaluator system 102 creates at least one predictive model that estimate parts of traffic flow (e.g., traffic flow in a particular area, high variance areas, etc.) The evaluator system 102 can receive an evaluation request that triggers analysis of a flow system representation 104 and results in a set of values indicative of the utility of data associated with various sections of the flow system (e.g., utility of high congestion during rush hours when the evaluation request is made at 2 a.m.) Alternatively, utility values can be automatically generated either periodically or dynamically. For example, valuation can be triggered by changes to the flow system (e.g., road construction). Valuation can also be triggered by contextual information, such as for example time of day data.

The evaluator system 102 can access a flow system representation 104 that describes probable flow within the flow system. In one aspect, the flow system representation can alter as context changes. In a particular example, the flow system representation 104 can be and/or include a weighted graph, where nodes of the graph represent intersections, edges represent road segments between the intersections, and weights associated therewith represent average travel speeds or traffic volume for the road segments/intersections. The weights can alter as context alters. For instance, a first weight can be provided for a road segment at a first time of day and a second weight can be provided to the same road segment at a second time of day. Thus, the flow system representation 104 can represent how traffic flows alter given different times of day (e.g., rush hour versus non-rush hour), days of week (e.g., weekday versus weekend), weather conditions (e.g., raining versus sunny), and other suitable contextual data.

In connection with the flow system representation 104, flows (e.g., a manner in which traffic is moving or expecting to move) at road segments can be represented by probability distributions over traffic flows and these probability distributions can be a function of contextual observations such as time of day, day of week, calendar information, flows seen at earlier times, and/or flows in other parts of the traffic system. Probabilistic forecasting models can be trained, wherein the models employ one of multiple forecasting methods that take current flows across a traffic system and compute forecasts about future flows on the traffic system, where predictions for future flows can be targeted for different contexts.

The evaluator system 102 can include a section component 106 capable of dividing the flow system into individual sections (e.g., road segments), where each section can represent a geographical region associated with the flow system representation 104. For example, each section can represent a city block, a mile of road, an intersection or any other logical division of the flow system representation 104. Sections can be uniform in length or area, or alternatively, sections can be heterogeneous. For example, sections associated with a downtown area can be smaller than those associated with less populated regions. Sections can be determined based upon operator input or standardized divisions. Alternatively, sets of sections can be inferred based upon the flow system representation 104. Sets of sections defining one or more flow systems can be maintained in a valuation data store 108 associated with the evaluator system 102. A data store as used herein, is a collection of data, including, but not limited to a database or one or more data files. Alternatively, a flow system representation 104 can maintain a collection of sections used for evaluation.

If the flow system is monitored using stationary or fixed position sensors, a section can represent a single sensor or a collection of physically proximate sensors. Fixed position sensors (e.g., stationary cameras or pressure sensor embedded in the road) remain consistently associated with a single geographical region. Here, the flow system can be divided into sections that represent one or more specific sensors rather than geographic divisions of the flow system. Consequently, each fixed sensor within the flow system can have a value indicative of the utility of data generated by the sensor.

The evaluator system 102 can also include a valuation component 110 that generates utility values for sections of the flow system. The valuation component 110 can access the flow system representation 104 to generate utility values for one or more sections of the flow system. Utility values can reflect usefulness of data associated with the section. Utility values produced by the valuation component 110 can be maintained in the valuation data store 108 or provided to a variety of systems.

Utility value of a section can be based upon a number of factors including, but not limited to relevance of section data in identifying and predicting bottlenecks. As used herein, a bottleneck is a region of heavy congestion that frequently results in reduction of traffic speed. Typically, bottlenecks occur at reasonably consistent locations based upon flow of traffic and flow system limitations and conditions. For example, almost every city has one or more interchanges or intersections that become heavily congested during rush hours. Accordingly, information regarding status of these regions of interest or critical regions can be more useful in predicting flow throughout the system than information regarding lesser-used side streets. Data for sections of the flow system proximate to the regions of interest can also reflect likelihood of a back up within a critical region. Value of data associated with a particular section of the flow system can be based upon likelihood that the data will identify a bottleneck.

The valuation component 110 can utilize probabilistic models in determining a value for a section. One of several discriminative or generative statistical methods can be employed for prediction and forecasting over time. These methods include statistical classifiers such as support vector machines, the use of Bayesian structure search within the realm of Bayesian machine learning, the learning and usage of dynamic Bayesian networks and related Hidden Markov Models, Continuous Time Bayesian Networks (CTBNs), and families of time-series methods such as those employing temporal Bayesian models, and models known as ARMA and ARIMA forecasting models.

The valuation component 110 can generate context specific utility values. The utility value corresponding to a section can vary depending upon context. For example, during morning rush hour, data associated with a section of inbound lanes of traffic on a major highway can have a relatively high utility value. However, in the evening, flow of traffic is generally reversed. The same section of inbound lanes of the major highway is unlikely to provide information regarding bottlenecks. Consequently, utility value associated with the section for evening rush hour should be correspondingly low. Other contextual information such as construction or weather conditions can also affect valuation of a section. Sections road prone to flooding can have high valuations during rainstorms, and significantly lower valuations during droughts. Utility values can vary, for example, based upon day of the week, weather conditions or any relevant other contextual data.

The evaluator system 102 can further include a context analyzer component 112 that analyzes context. For instance, the context analyzer component 112 can analyze the time of day. Additionally, the context analyzer component 112 can determine or receive information regarding day of the week, whether a day is a holiday, current or forecasted weather conditions, current status of roadways (e.g., whether and where an accident has been reported) and any other suitable contextual data. Utility values can be based at least in part upon contextual data.

The evaluator system 102 can also receive context information in the evaluation request. The valuation component 110 can access the context sensitive flow system representation 104 and using information specific to the current context can generate or produce a set of utility values for a set of sections. One or more collections of section utility values corresponding to various contexts can be maintained in the valuation data store 108.

Figure 2:
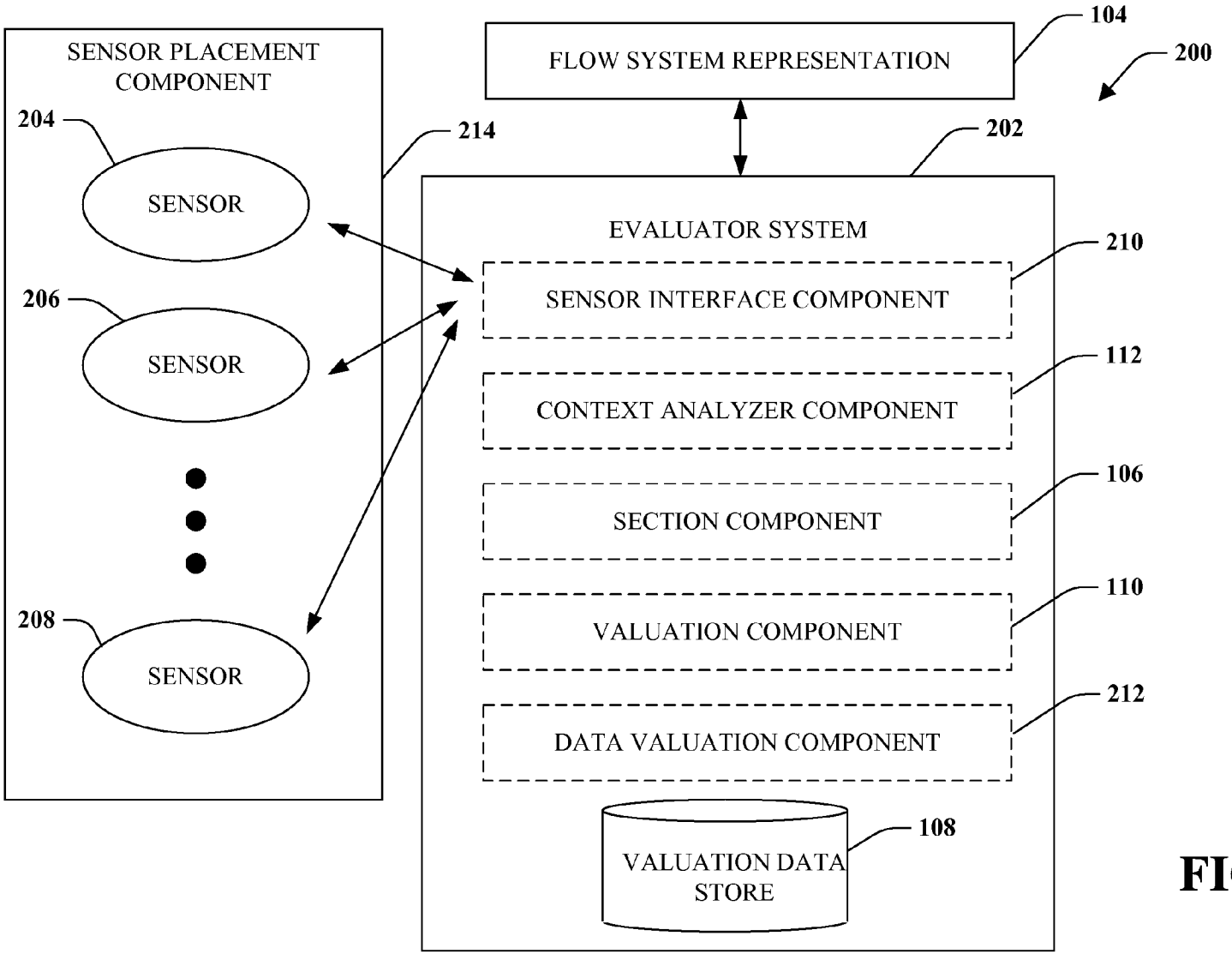
FIG. 2 is a block diagram of a system for associating utility values with sensor data in accordance with the subject matter described herein.

Referring now to FIG. 2, a system 200 for associating a utility value with sensor data is illustrated. In FIG. 1, various examples are presented regarding variance of road speeds. There are times when using general contexts are insufficient and variance levels still remain relatively high. When this takes place, sensors 204-208 can be employed For example, two streets, Street A and Road B, can experience high amounts of traffic. Street A can be located in a downtown area; since there are various rationales for why Street A would be busy (e.g., city center, near major businesses, etc.), contextual data can be used to explain why Street A is so busy. However, Road B can be quite busy with no contextual rationale as to traffic source. Since conventional means do not work for Road B, sensors 204-208 are used to justify traffic patterns in Road B.

The evaluator system 202 can receive a set of formatted sensor data, including data indicative of flow associated with geographic locations and types of sensors used to collect the sensor data. Alternatively, the evaluator system 202 can request, receive and/or obtain sensor data from one or more sensors 204-208. A sensor interface component 210 can be communicatively coupled to a plurality of sensors 204-208 that are utilized to determine state of a traffic system (or other suitable system where the concepts described herein can be employed). The sensors 204-208 can include pressure sensors embedded within road segments and utilized to determine rate of traffic flow and/or number of vehicles within a region. Sensors 204-208 can also include visual image sensors including, but not limited to, satellite images and video cameras (e.g., stationary cameras as well as cameras mounted on a helicopter, blimp, etc.). The sensors 204-208 can additionally be associated with web sites that describe traffic events and radio stations that monitor traffic within a region. Additionally, the sensors 204-208 can include sensors associated with individual vehicles, such as GPS receivers, speedometers, accelerometers, etc. A fleet of vehicles, such as buses, taxis and delivery vehicles can be used to monitor traffic flow. The sensor interface component 210 can function as a reception component that obtains data from an auxiliary source (e.g., sensors.)

Sensors can also be attached or included in portable devices, where a portable device can be any suitable device that can maintain a connection to a network, such as personal digital assistants (PDAs), smart phones, cellular phones, a laptop computer and the like. The portable device sensor can include a location sensor, speed sensors or other useful sensors. More specifically, sensors can include a GPS receiver, speedometer and an accelerometer. As portable device users travel, data from the sensors can be received by the sensor interface component 210. Foot traffic as well as vehicular traffic can be monitored using portable sensor devices.

The sensor interface component 210 can receive data from a predefined set of sensors. Alternatively, an ad hoc set of sensors can be used to collect sensor data provided to the sensor interface component 210. For example, the sensor interface component 210 can receive sensor data from a set of cell phone users who elect to provide their location information.

The sensor interface component 210 can be configured to receive continually sensor data. Alternatively, the sensor interface component 210 can obtain sensor data dynamically or on a periodic basis. The sensor interface component 210 can format data for use by traffic flow systems. The sensor interface component 210 can integrate sensor data received from a heterogeneous set of sensors (e.g., data received from GPS and video surveillance).

The evaluator system 102 can further include a context analyzer component 112 that analyzes context of the sensor data. For instance, the context analyzer component 112 can analyze the time of day at which the data was recorded. Additionally, the context analyzer component 112 can determine or receive information regarding the day of the week, whether a day is a holiday, current or forecasted weather conditions, current status of roadways (e.g., whether and where an accident has been reported) and any other suitable contextual data associated with the received sensor data. Valuation of data can be based at least in part upon contextual data. The context analyzer component 112 can receive, request and/or obtain context data from a plurality of data sources (not shown). The data sources can be any suitable data sources. For instance, the data source can be a website that describes current/forecast weather conditions. In another example, the data source may be a radio station that announces traffic accidents, wherein the context analyzer component can understand and interpret particular words relating to such accidents.

A data valuation component 212 can generate utility values for sensor data provided by the sensors 204-208. Utility values can be based upon in part upon the section of the flow system in which the sensor data was collected. The location data associated with received sensor data can be used to determine the section of the flow system. Based upon the section and/or context the valuation component 110 can generate a utility value or retrieve a predetermined utility value from the valuation data store 108.

Additionally, utility value can be affected based upon the type of sensor used to generate the sensor data. For example, accuracy of sensor data can vary based upon the type of sensor used to collect sensor data. Utility values can be adjusted to reflect the reliability of the sources of the sensor data.

Sensor data with an associated utility value can be used for a variety of purposes. For example, utility value can be used in selecting sensor data for processing during route generation, particularly where the system has limited processing power or bandwidth. In addition, utility value can be critical in planning, upgrade or maintenance for a flow monitoring system.

The data valuation component 212 can use generated utility values to construct at least one predictive model of variance. For example, the data valuation component 212 can build a model to predict variance of observed road speeds. Variances are predicted on a continuous basis as well as done for a specified range (e.g., during times designated as 'rush hour.')

Output of a predicted model from the data valuation component 212 can be used by a sensor placement component 214. The sensor placement component 214 can determine an area that would benefit from addition of at least one sensor 204-208. The sensor placement component 212 can utilize internal logic to make determinations or inferences as to where a sensor should be placed. Conventionally, a sensor is placed on a road where the sensor will provide data with a high improvement value (e.g., quality of information without the sensor against quality of information with the sensor.) However, this can be difficult to measure and therefore various proxies can be used to determine roads that will likely benefit from an addition of sensors (e.g., placement of a sensor at a road that is predicted to be of high variance.) Sensors 204-208 are placed in an attempt to collapse the variance/road reliability.

Figure 3:
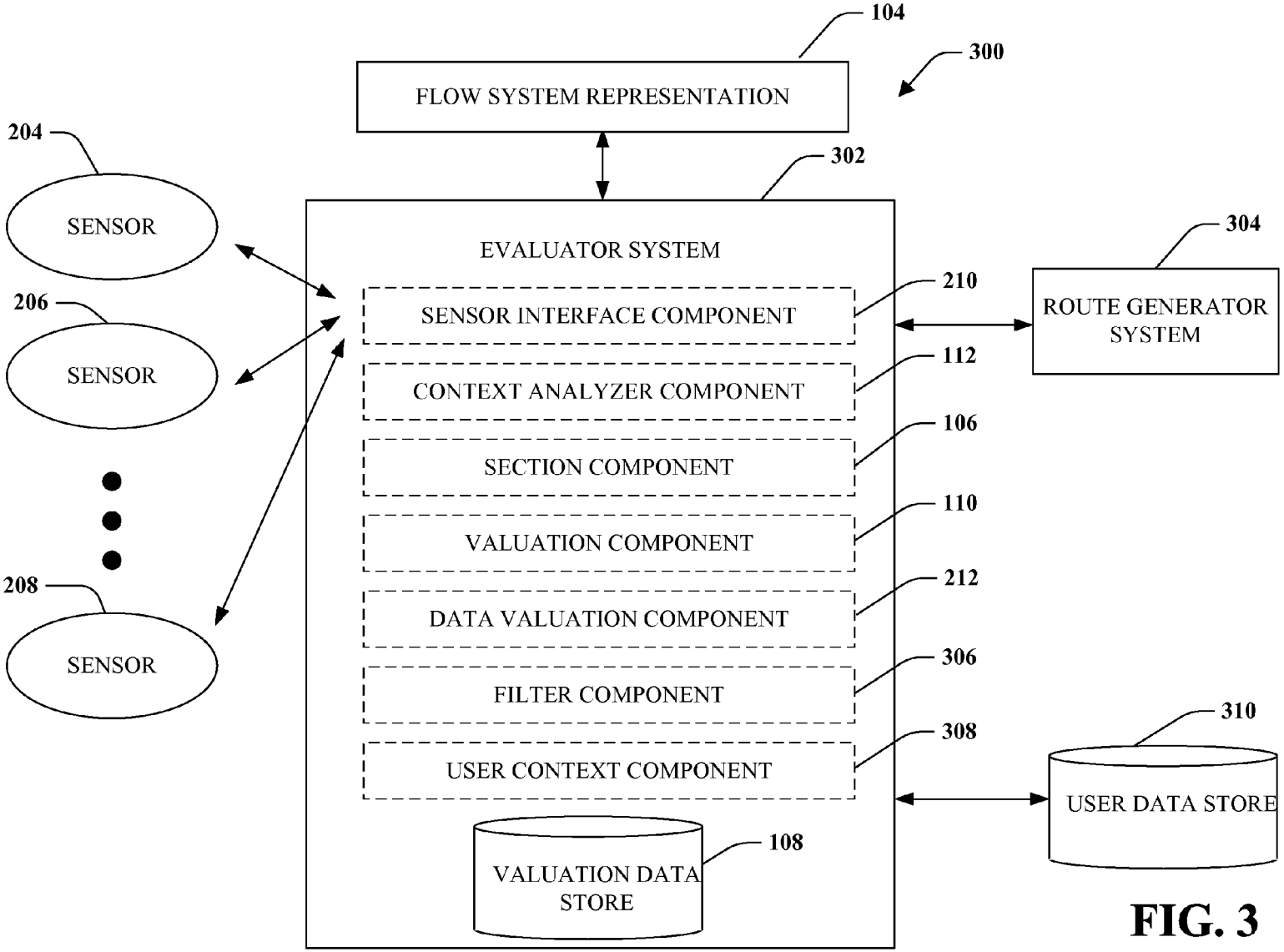
FIG. 3 is block diagram of a system for filtering sensor data using utility values in accordance with the subject matter described herein.

Referring now to FIG. 3, a system 300 for filtering sensor data based upon utility value is illustrated. An evaluator system 302 receives sensor data collected by a plurality of sensors 204-208, assigns utility values to the sensor data and outputs a subset of the sensor data based at least in part upon the utility values. Total volume of sensor data output can be reduced to provide for systems with limited connectivity or limited processing capability. For example, a route generator system 304 in a mobile device (e.g., smartphone or PDA) may have limited connectivity or processing power. Performance of the route generator system 304 can be optimized if only the most useful sensor data is transmitted when the route generator system 304 is in communication with the evaluator system 302. Providing sensor data based upon utility value can increase likelihood that the route generator system 304 will be able to predict and avoid bottlenecks while receiving limited sensor data.

The evaluator system 302 can generate utility values associated with received sensor data based upon the flow system representation 104, sensor data context and sensor type as described in detail above. A filter component 306 can identify the most important subset of sensor data for transmission to the route generator system 304 as a function of utility value of the sensor data. Filtration can be performed using predetermined thresholds that can be maintained in the valuation data store 108 or specified by the route generator system 304. Sensor data with a utility value below a predetermined threshold can be removed from the set of sensor data to be transmitted to the route generator system 304. Alternatively, a fixed amount of data can be transmitted, where a predetermined amount of sensor data with the maximum available utility values is selected for transmission. Amount of data transmitted can be based at least in part upon the configuration and capabilities of the particular route generator system 304 or the related mobile device. Upon establishing a connection to the evaluator system 302, the route generator system 304 can specify a maximum amount of data for transmission, data rate or other sensor data transmission limitations.

The utility value of sensor data can also be affected by the context of the route generator system 304. The route generator system 304 can provide contextual data to the evaluator system 302 such as current location of the mobile device, desired destination and user preferences. A user context component 308 can utilize data received from the route generator system 304 to adjust utility values to reflect utility to the particular route generator system 304. Alternatively, or in addition to information provided by the route generator system 304, the user context component 308 can access a user data store 310 that can include one or more user profiles that specify user preferences (e.g., avoid highways and avoid bridges). The user data store 310 can also include history data that indicates frequently used routes for a particular user.

Historical data or preferences can indicate probable future routes of the user. Consequently, the utility value of sensor data related to such routes is greater for the particular user than for users in general. The user context component 308 can adjust utility values to reflect individual preferences of a particular user. These modified utility values can be used by the filter component 306 to ensure that the route generator system 304 receives the sensor data most relevant to the particular user.

Alternatively, the user data store 310 can include a set of non-specific driving profiles. The driving profiles can include profiles that are based upon demographics, monitored driving preferences, and the like. Users can be matched to one of a set of generic driving profiles, rather than a user specific profile. For example, drivers at or near retirement age may not wish to travel over highways associated with a significant amount of traffic congestion, and will increase travel time to avoid such highways. Drivers in their twenties, however, may be more willing to travel over such highways to reduce travel time. Drivers' typical areas of driving can also be indicative of driving preferences, as individuals from small towns may be less likely to travel over busy roads proximate to a large city than those who typically drive in large cities. Thus, numerous profiles can be defined that map to how different users prefer to drive. The profiles can indicate route preferences, affecting the utility value of sensor data.

Figure 4:
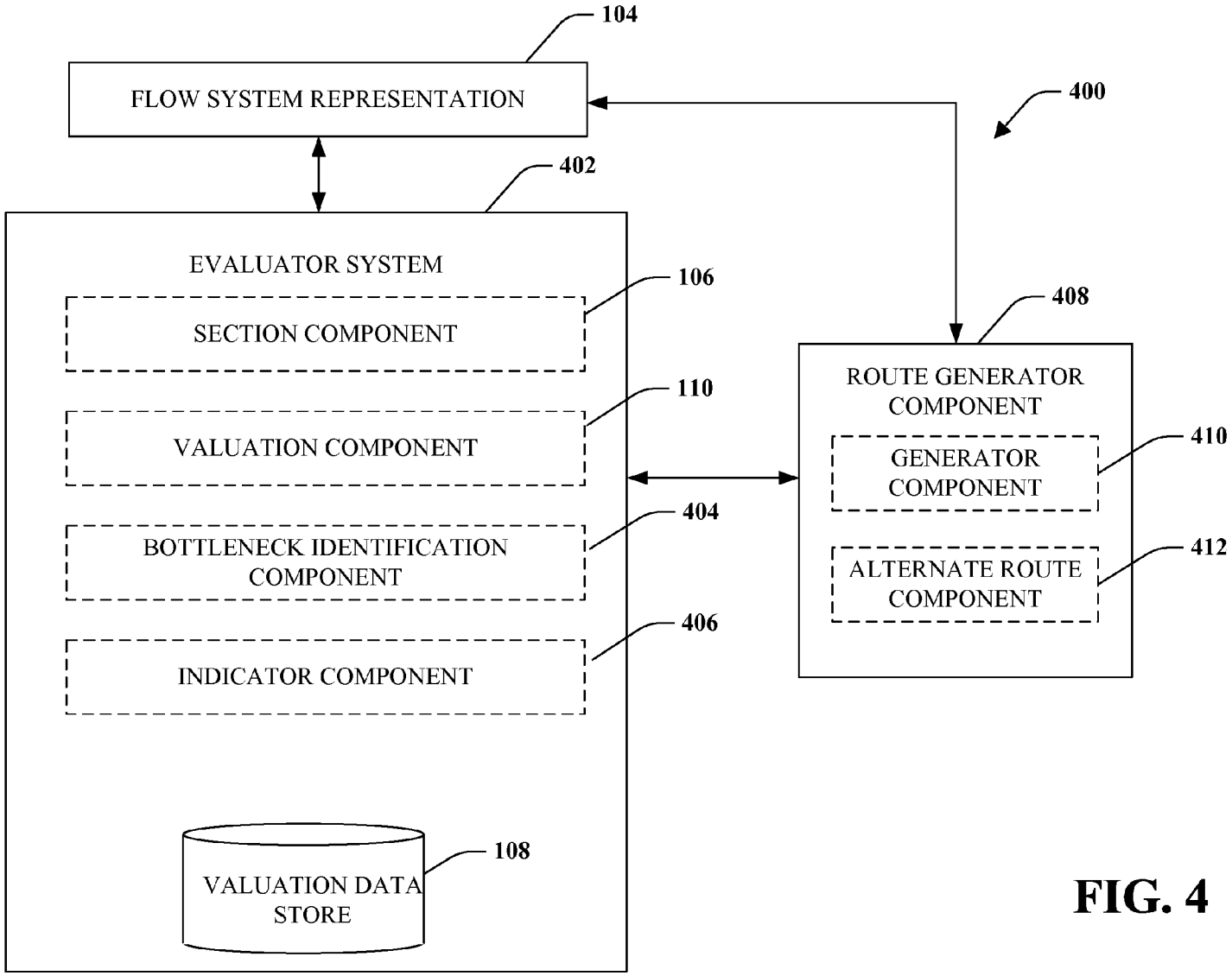
FIG. 4 is a block diagram of a system for generating directions including alternate routes using utility values in accordance with the subject matter described herein.

Referring now to FIG. 4, a system 400 for route planning using utility values is illustrated. Utility values for sections of a flow system can be used to identify sections or portions of the flow system that are probable bottleneck locations. In addition, sections proximate to the probable bottleneck locations or indicative of the occurrence of bottlenecks can be identified. These sections are referred to herein as bottleneck indicator sections. Information regarding status of these sections can be critical in route planning. Directions can include alternate routes that can be selected based upon conditions at a bottleneck indicator section. If a user does not have access to sensor data to evaluate conditions at these bottleneck indicator sections, the user can act as a sensor as he or she approaches a bottleneck indicator sections. For example, a set of generated directions to a user specified destination can direct a user to Interstate 90. An intersection proximate to the entrance ramp can be identified as a bottleneck indicator section. As the user approaches the interstate, the generated directions can indicate that if traffic on Interstate 90 appears heavily congested, an alternate route using side streets is available. The directions can be static, such as a computer printout of generated directions. Alternatively, the directions can be provided using a graphic user interface (GUI), particularly if the device supporting the GUI has no, or limited connectivity.

To provide directions with one or more alternate routes, an evaluator system 402 can access a flow system representation 104 to evaluate sections of the flow system, as described above in detail. The evaluator system 402 can include a bottleneck identification component 404 that identifies portions of the flow system likely to experience bottleneck conditions based in part upon utility values. The bottleneck identification component 404 can identify likely sections for bottlenecks based upon past bottleneck occurrences. A bottleneck indicator component 406 can identify those sections of the flow system most likely to indicate a bottleneck. Bottleneck indicator sections would include not only those located at the bottleneck, but those sections proximate to the bottlenecks or indicative of the presence of a bottleneck within the flow system. Information regarding likely bottlenecks as well as bottleneck indicator sections can be provided to a route generator system 408.

The route generator system 408 can access the flow system representation 104 to plan routes in accordance with user requirements. In addition, the route generator system 408 can receive information regarding likely bottlenecks and bottleneck indicator sections from the evaluator system 402. The route generator system 408 can include generator component 410 that creates a route based upon best available data at time of generation. In addition, the route can be based in part upon individual user requirements and predicted context. An alternate route component 412 can generate alternate routes or portions of routes based upon the probable locations of bottlenecks. The route generator system 408 can generate directions that suggest use of alternate routes based upon conditions at the bottleneck indicator sections. The set of directions, including alternatives can be printed prior to the journey. The alternative routes can be selected based upon user observed road conditions.

Figure 5:
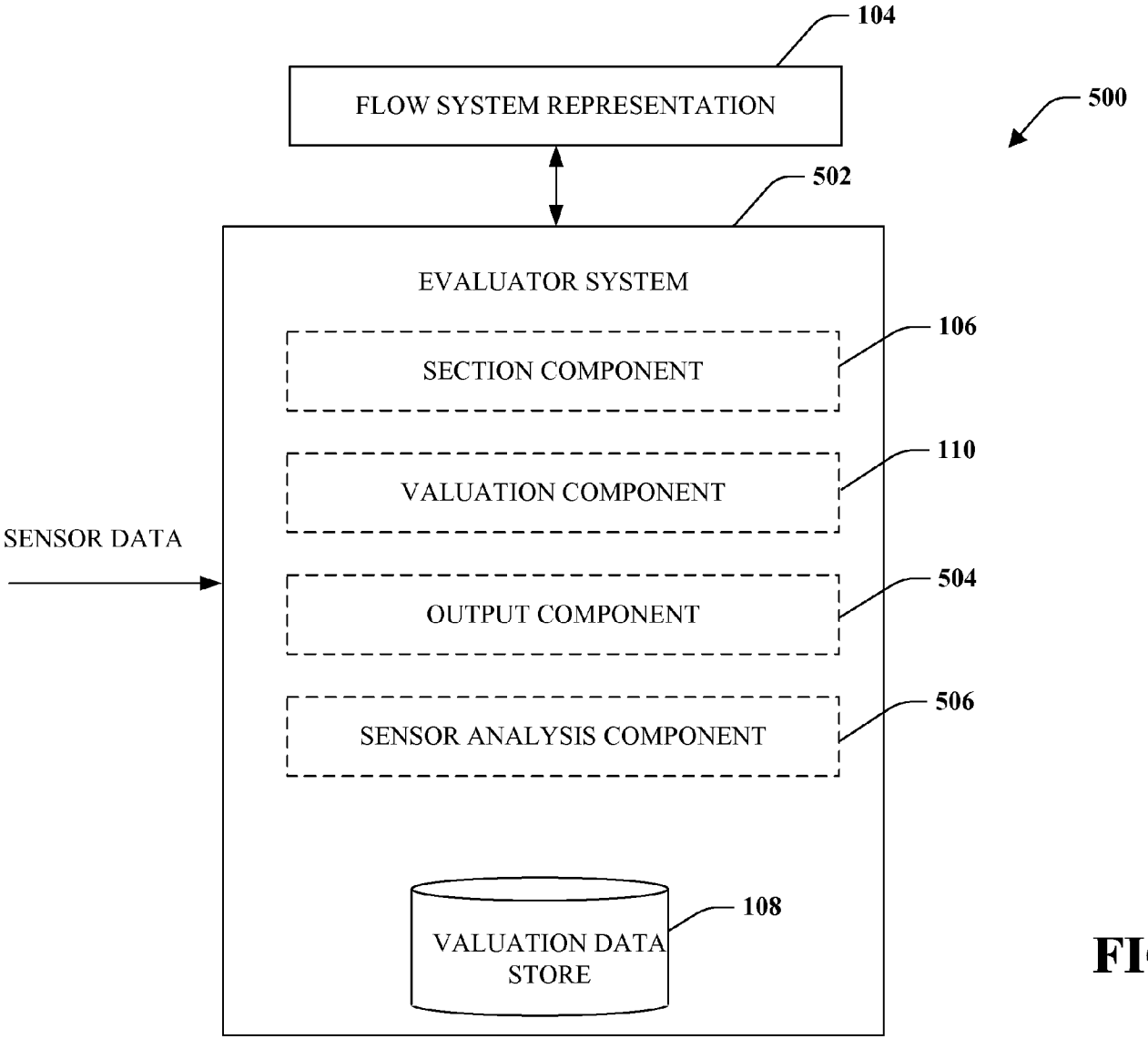
FIG. 5 is a block diagram of a system for managing a flow monitoring system using utility values in accordance with the subject matter described herein.

FIG. 5 illustrates a system 500 for designing, upgrading and/or maintaining a flow monitoring system. An evaluator system 502 can access a flow system representation 104 and generate utility values associated with various sections of the flow system, as described in detail above. An output component 506 can provide an operator with information regarding utility value of data for various sections of the flow system. The information can be provided using a GUI interface, a printed report, an email, or any other method of providing information. The provided information can include a list of flow system sections, prioritized based upon the generated utility values. Thus, sensor analysis information can include a prioritized list of a number of sections.

The evaluator system 502 can also utilize sensor data to analyze performance of the flow monitoring system. A sensor analysis component 506 can analyze sensor data including information regarding location of sensors to determine whether the distribution of received sensor data from various sections of the flow system is consistent with the relative utility value of the data received from the sections. For example, the sensor analysis component 506 can identify sections with a high utility value, indicating relative importance of data from such sections, from which the system has received relatively little sensor data. The sensor analysis component 506 can identify those areas where it would be desirable to enhance the amount of sensor data or rate at which sensor data is collected to improve monitoring and prediction of traffic flow.

Information generated by the sensor position analysis component 506 can be presented to an operator by the output component 504. This information can be used in the design of a flow monitoring system. Additionally, the information can be used to select placement of additional sensors (e.g., stationary or fixed sensors) or replacement of older, less sensitive sensors with new, improved sensors. The information can also be used to prioritize sensor maintenance, ensuring that sensors associated with the sections having the highest utility values are regularly maintained.

Figure 6:
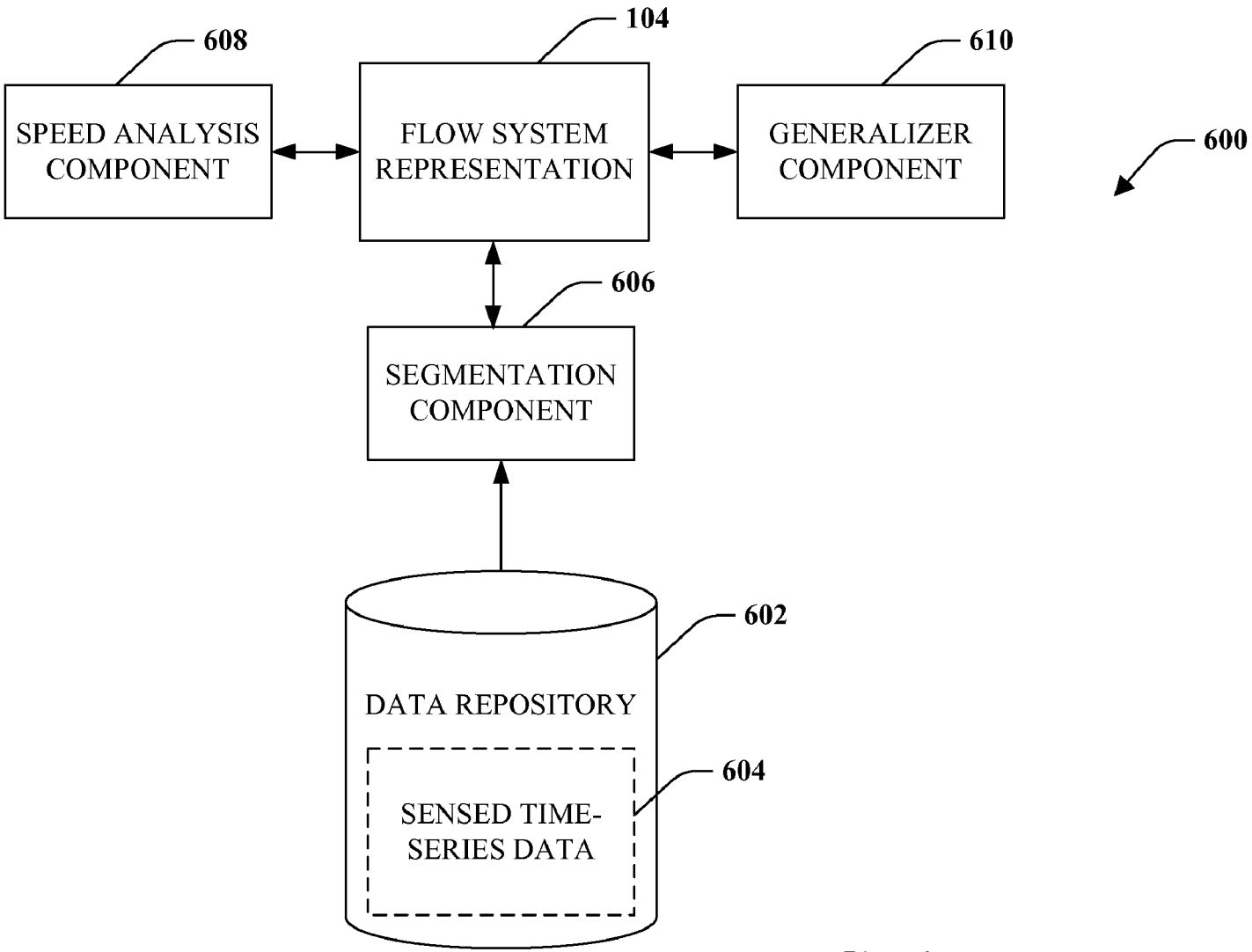
FIG. 6 is a block diagram of a system for building/refining a flow system representation whose contents alter as context changes.

Referring now to FIG. 6, a system 600 for building a robust flow system representation is illustrated. The system 600 includes a data repository 602 that includes sensed time-series data 604, wherein such data can be collected from a plurality of sensors (e.g., drivers as they travel through a traffic system). For example, the sensed time-series data 604 can be obtained by associating location/velocity-determining sensors (such as GPS receivers) with a plurality of drivers in a traffic system (e.g., a metropolitan traffic system). As data is generated from the sensors, such data can be associated with time-stamps. Thus, trace logs for each respective driver associated with the location-determining sensor(s) can be generated and placed within the sensed time-series data 604. A segmentation component 606 can be employed to discern when individual journeys stop and start. As sensors associated with automobiles cease recording when the vehicles stop moving for a threshold amount of time, most (but not all) individual journeys taken by the drivers can be identified by the segmentation component 606 through reviewing time gaps that appear in the sensor logs.

The flow system representation 104 can be built/defined based at least in part upon the sensed time-series data 604, and can be or include a graph, where nodes in the graph represent intersection of roads and edges represent road segments. A single road may be represented by multiple edges, as each road segment (the smallest unbroken portion of a road between two intersections) can be a separate edge in the graph. Additionally, the edges and nodes can be associated with latitudes and longitudes of roads that they represent. Once the sensed time-series data 604 has been segmented into individual journeys, such journeys can be "snapped" to the flow system representation 104 through any suitable manner.

Once the trace logs are mapped into road segments, a speed analysis component 608 can associate different weights to edges/nodes within the graph of the flow system representation 104 over different times. For example, the speed analysis component 608 can learn time-dependent traffic speed for roads by breaking days of the week into multiple categories and breaking such categories into several time slices. For purposes of illustration, it can be assumed that the speed analysis component 608 breaks the days of the week into two categories: weekdays and weekends. Such categories can then be broken into 96 time slices: 15-minute blocks of time covering 24 hours of the day. It is understood, however, that the speed analysis component 608 can create categories associated with any sort of contextual data. For instance, the speed analysis component 608 can create categories based upon weather conditions, holidays, and the like.

Continuing with the above example, the speed analysis component 608 can learn a separate average speed for each time-of-day and weekday/weekend breakdown by examining each pair (A, B) of consecutive GPS points in snapped traces. The average speed of a driver between each pair can be calculated, and the speed can be utilized to create a running average for every road segment traversed to get from A to B. Speed measurements can be applied to the running average associated with a block of time whose time characteristics match those of timestamps of collected data involved in the speed calculation. Thus, the speed analysis component 608 can determine speeds associated with road segments in various categories (time of day, day of week, . . . ) The speed analysis component 608 can then associate such data with the flow system representation 104, such that edges and nodes are weighted based upon the collected data.

It can be discerned, however, that it may be impossible to obtain data for every road in a traffic system over every category. Thus, road speeds can be generalized given known road speeds of "similar" road segments. In more detail, a generalizer component 610 can analyze the flow system representation 104 and provide speed values to road segments that are not associated with collected data for each category. For instance, for road segments and time segments where no data is available, the generalizer component 610 can assign the speed that is associated with the same road segment at an adjacent time block. If there is no speed associated with an adjacent time block, the generalizer component 610 can assign the segment a speed from a similar road and/or a system-wide average of speeds from similar roads, where similarity can be defined by road class within the flow system representation 104. Additionally, similarity can be determined by analyzing speed limits, geographic proximity of road segments, geographic location of road segments, and the like. Still further, if similar roads cannot be located and/or if a system-wide speed average is unavailable, the speed for a time segment can be defined as the posted speed limit. Moreover, the generalizer component 610 can utilize machine-learning techniques/systems to learn patterns/correlations within the flow system representation 104 and assign average road speeds to road segments based at least in part upon learned patterns, correlations, and/or trends.

Figure 7A:
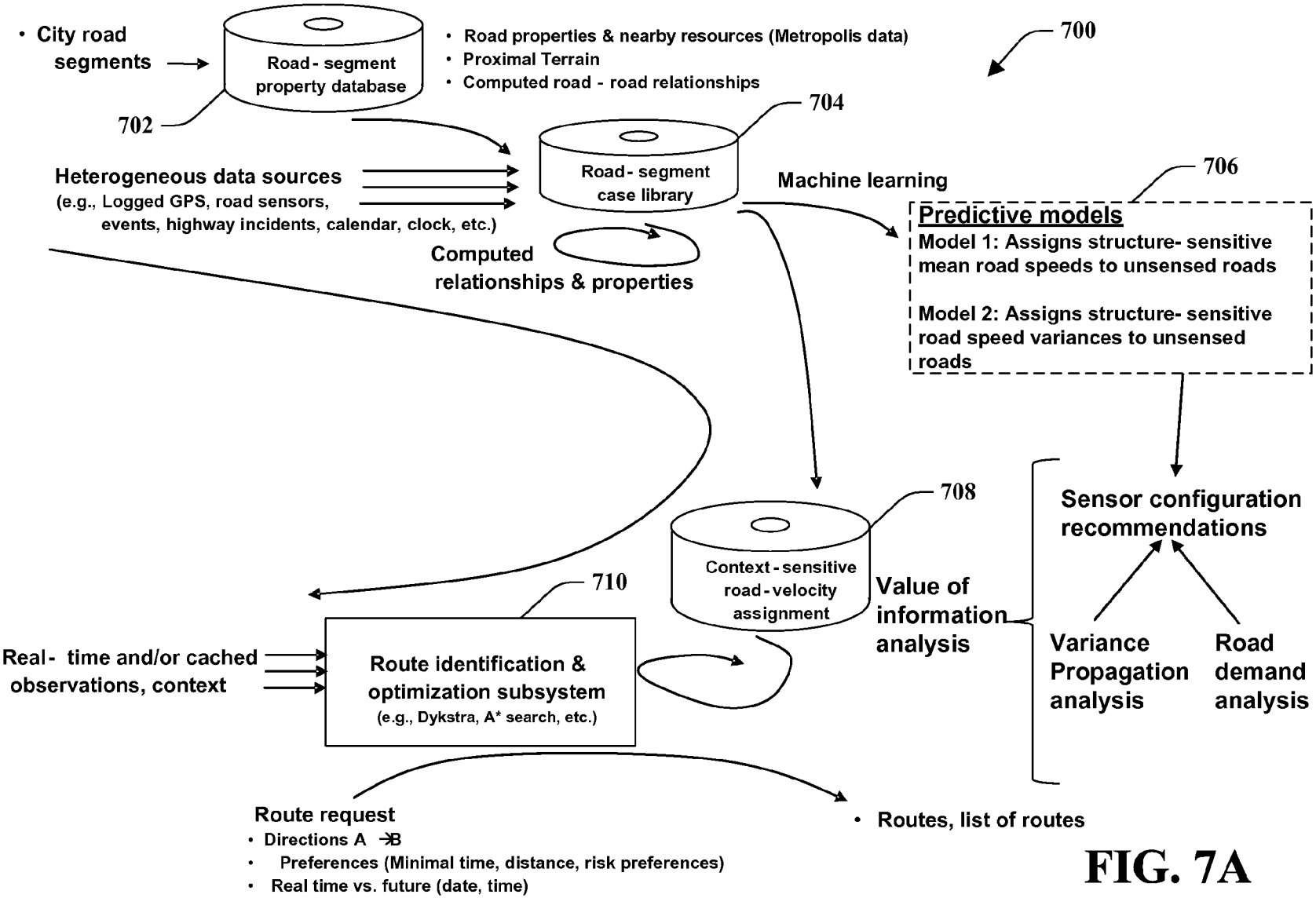
FIG. 7A is a representative analysis system in accordance with at least one aspect of the subject specification.

FIG. 7A depicts an example analysis 700 using various aspects disclosed in the subject specification. A database 702 (e.g., road-segment property database) holds various amounts of information concerning infrastructure of an area. Road segments held in the database 702 can range from highways to footpaths. Contents of the database 702 can derive from a number of different sources. For example, a central server can hold road properties and nearby resources. The database 702 can communicate with the central server to receive up-to-date information concerning different road portions. A specific road portion can be under construction and thus closed. This information transmits from the central server to the database 702 so the information can be used by other parts of the analysis 700. Other areas that can provide content to the database 702 are proximal terrain and road relationships from the central server.

Data from the database 702 can travel to a library 704 (e.g., road-segment case library.) The library 704 integrates information from the database 702 with data collected by various data sources (e.g., sensors.) Commonly, the data sources are heterogeneous; however, other configurations can be used as well as mixed configurations (e.g., heterogeneous data sources and non-heterogeneous data sources together.) Example data sources are a global positioning system (GPS), a road sensor, an event, a highway incident, a calendar, a clock, etc. The library 704 can compute relationships and properties that relate to information from the database 702 as well as from the data sources.

Contents of the library 704 are received (e.g., through a reception component) and processed through machine learning to create predictive models (e.g., operations performed by data valuation component 212 of FIG. 2.) One or more predictive models 706 concerning anticipating traffic variance can be outputted from a classifier learned via machine learning from a representative data set. For example, two models can be transferred from the machine learning component; a first model can be used to forecast road speed while a second model is for anticipation of variance of road speed.

From the predictive models, at least one determination can be made that relates to the value of information of potential new sensors. Variance propagation analysis can take place that assists in determining how the sensing of speed on a road segment will reduce the variance on the road speeds of related, unsensed road segments.

In addition, road demand analysis can also take place and analysis results can be used in value determination. Different roads can have different desire characteristics that should be taken into account. For example, an area can have multiple roads with varying speed limits. However, there can be one highway that stretches the area that does not have a speed limit (e.g., automobiles can travel as fast as they can without legal penalty.) There can be a high demand for the road with no speed limit and thus influence how automobiles travel on the road. The high demand of the road should be taken into account, as well as other characteristics (e.g., dangerous speeds on the road) in identifying the value of adding sensing to one or more regions of a road network.

Previously disclosed analysis and content of the predictive models can be used for recommendation of sensor configuration (e.g., operation of the sensor placement component 214 of FIG. 2.) Logic can be utilized to make a determination as to where sensors should be placed taking into account the analysis as well as the models 706. If a variance occurs often at a particular location, then it can be an indication that there can be a large amount of quality information that would be obtained if a sensor were placed at the location. However, if there is low demand at the location, then it is possible that it will be wasteful to place a sensor at the location since few people travel upon the location. An expected value of information analysis weighs these two pieces of information with various other data (e.g., other possible sites for sensors, particular characteristics of an area, etc.) to determine if a sensor should be placed at the location.

Furthermore, contents of the library can transfer to an assignment 708 (e.g., context—sensitive road—velocity assignment.) The assignment 708 can operate in a continuous refresh mode for a route identification and optimization subsystem 710. The subsystem 710 can be used to create a route that is improved and/or optimized for a particular operator of a vehicle. Information can be inputted into the subsystem 710, such as real time observations, cached observations, context, etc. Based on the inputted information, improvement/optimization can take place for a particular driver.

An instance of the function of the subsystem 710 involves a user making a route request (e.g., the user would like to travel from point A to point B.) Various preference information can be taken into account by the subsystem 710 (e.g., the user wants to have a quick route, does not want to travel a long distance, does not want to have a strong deviation from estimations, etc.) Based on the assignment 708 and the inputted information, a route list can be presented to the user. The user can then select an appropriate route and attempt to follow directions associated with the route. The subsystem 710 can function as a path component that generates a route for a vehicle based at least in part off the predictive model of traffic variance.

Figure 7B:
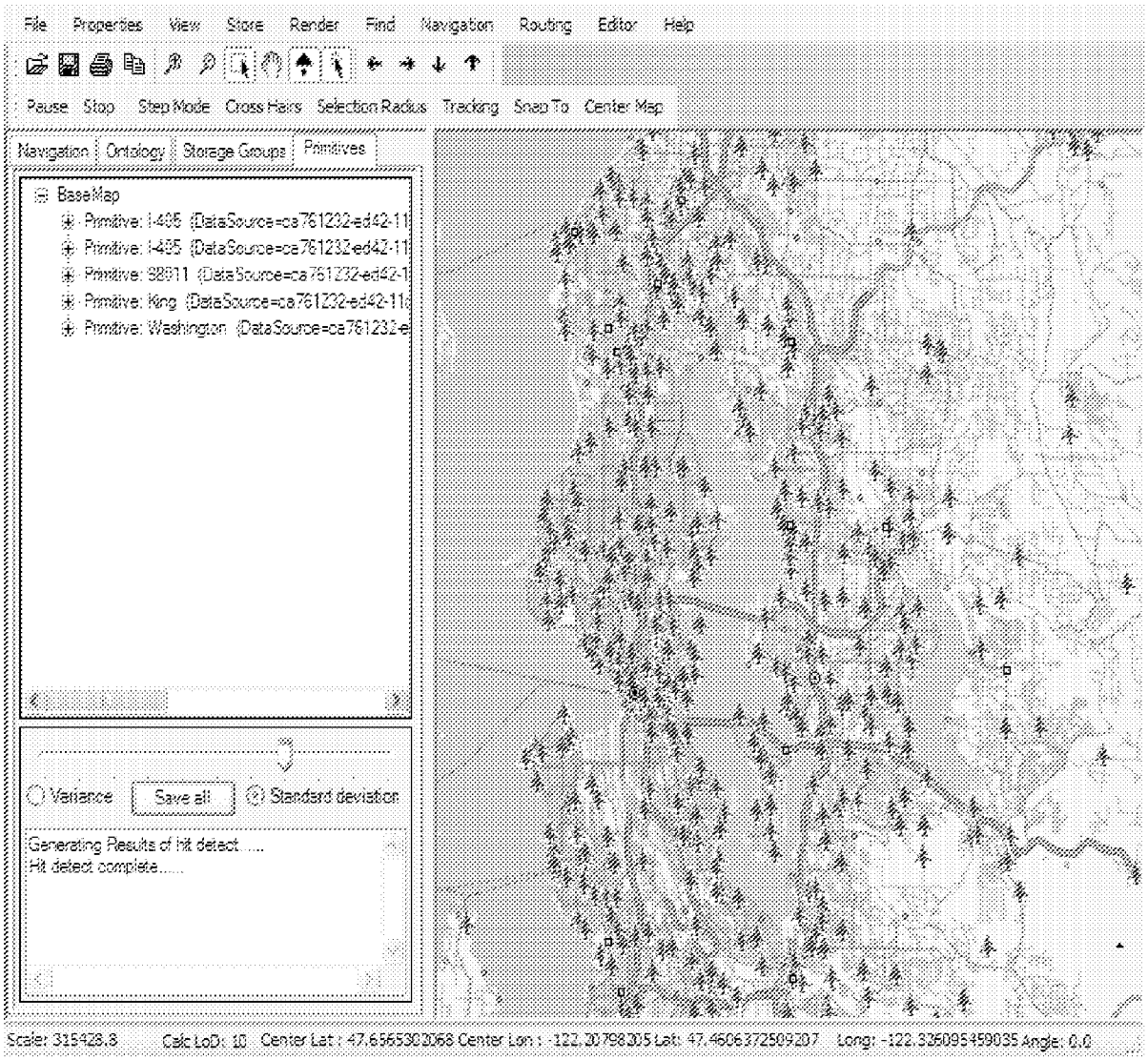
FIG. 7B is a representative display of a predictive model of traffic variance in accordance with at least one aspect of the subject specification.
Figure 7C:
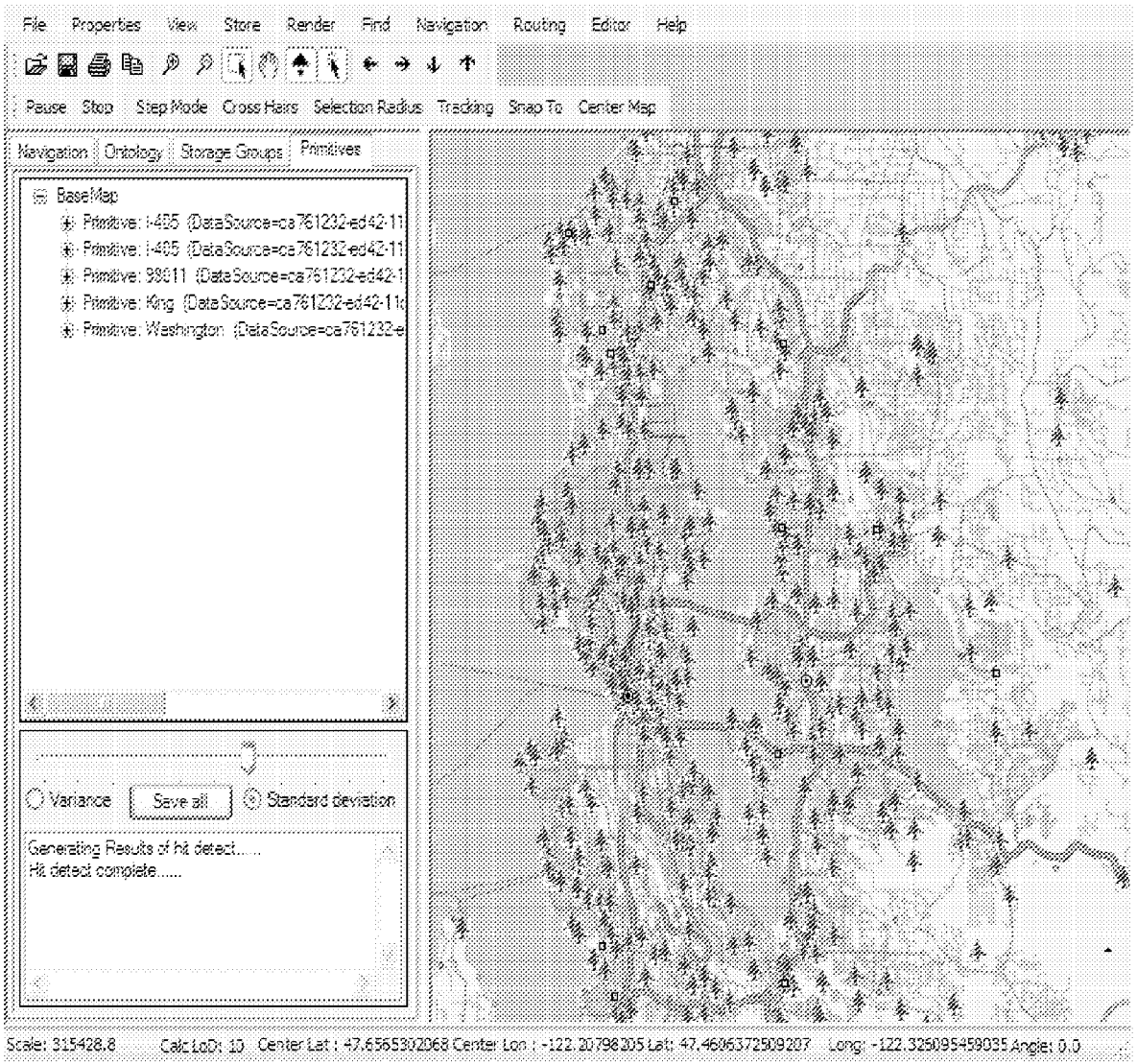
FIG. 7C is a representative display of a predictive model of traffic variance in accordance with at least one aspect of the subject specification.
Figure 7D:
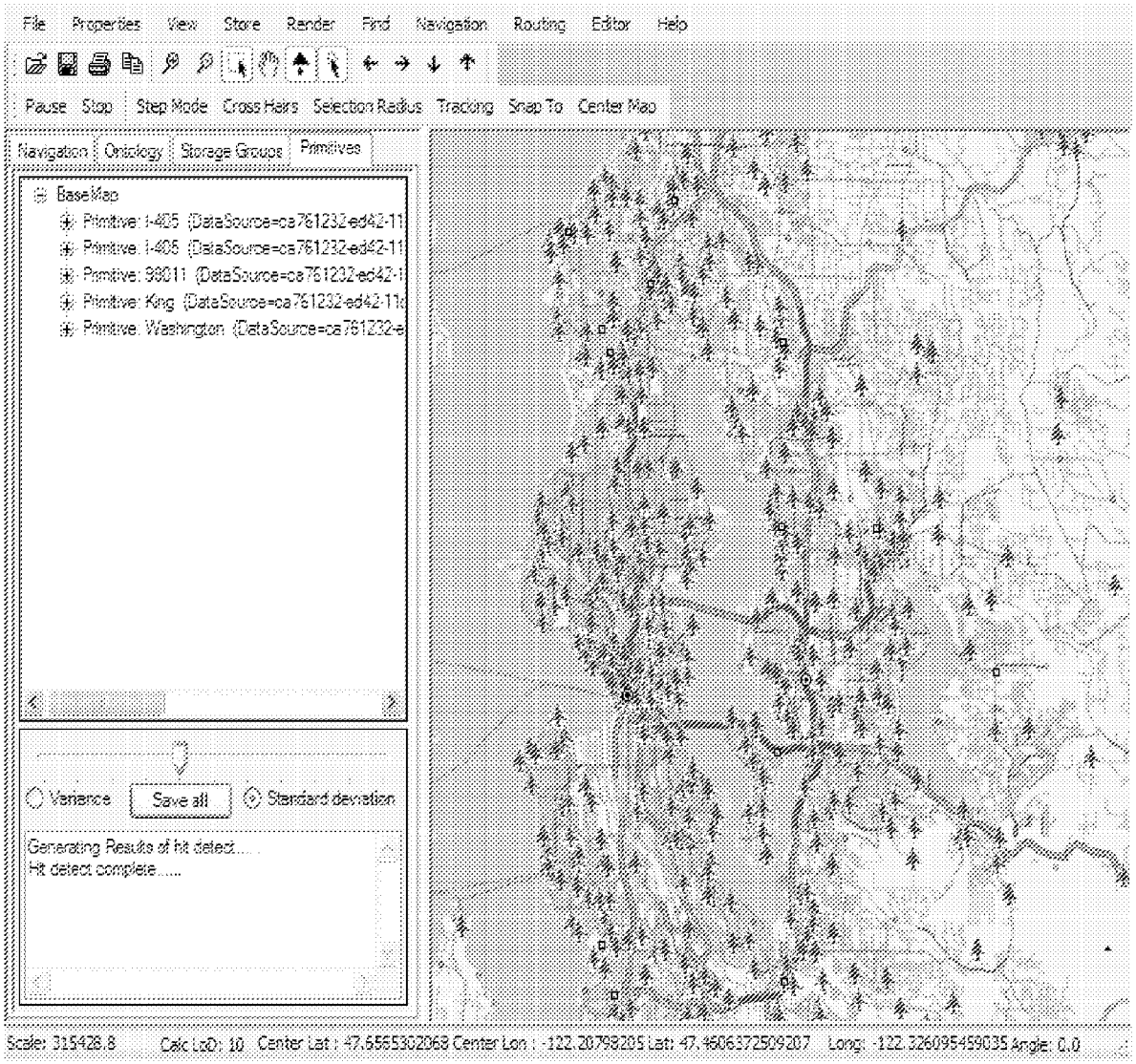
FIG. 7D is a representative display of a predictive model of traffic variance in accordance with at least one aspect of the subject specification.
Figure 7E:
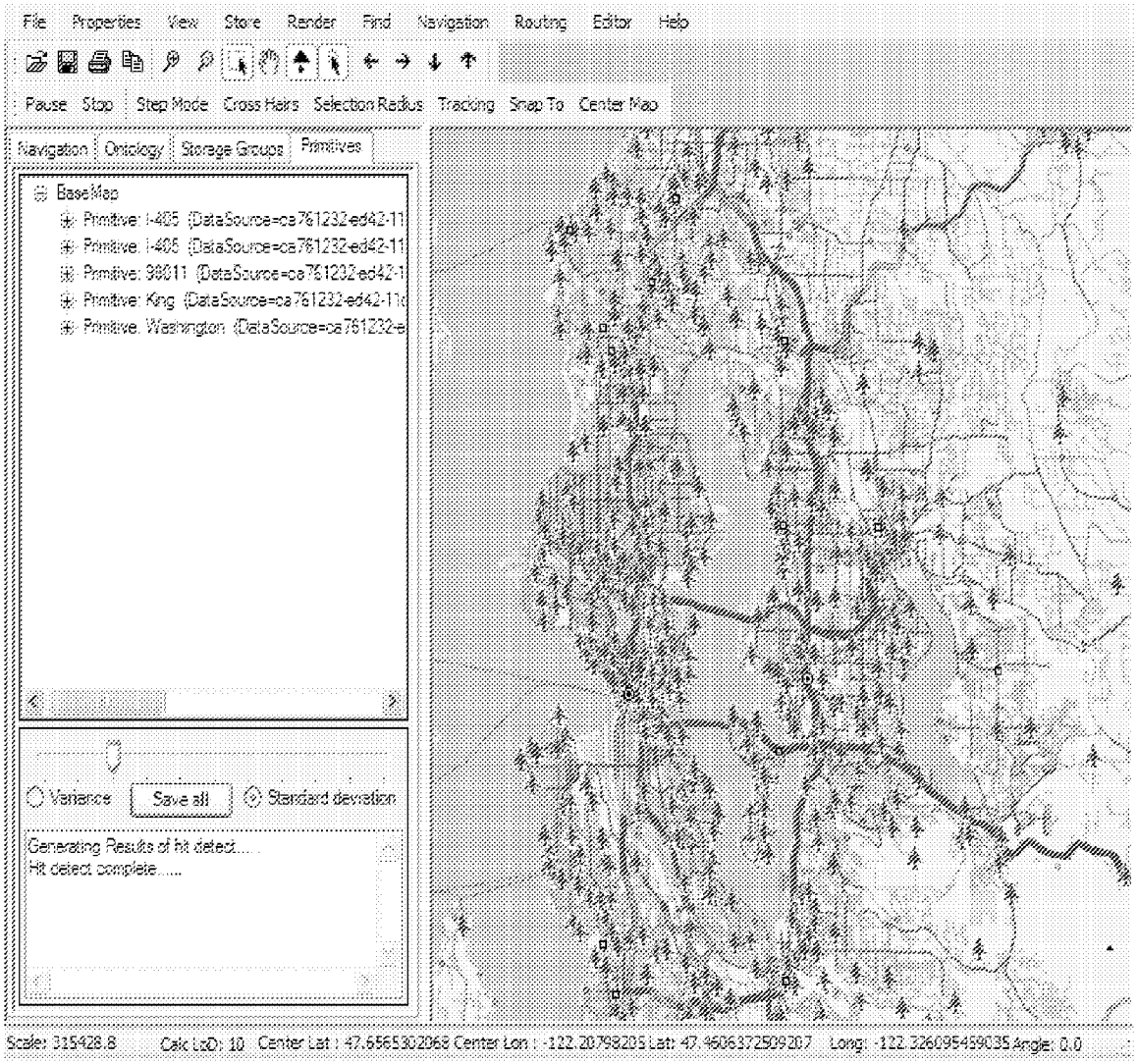
FIG. 7E is a representative display of a predictive model of traffic variance in accordance with at least one aspect of the subject specification.
Figure 7F:
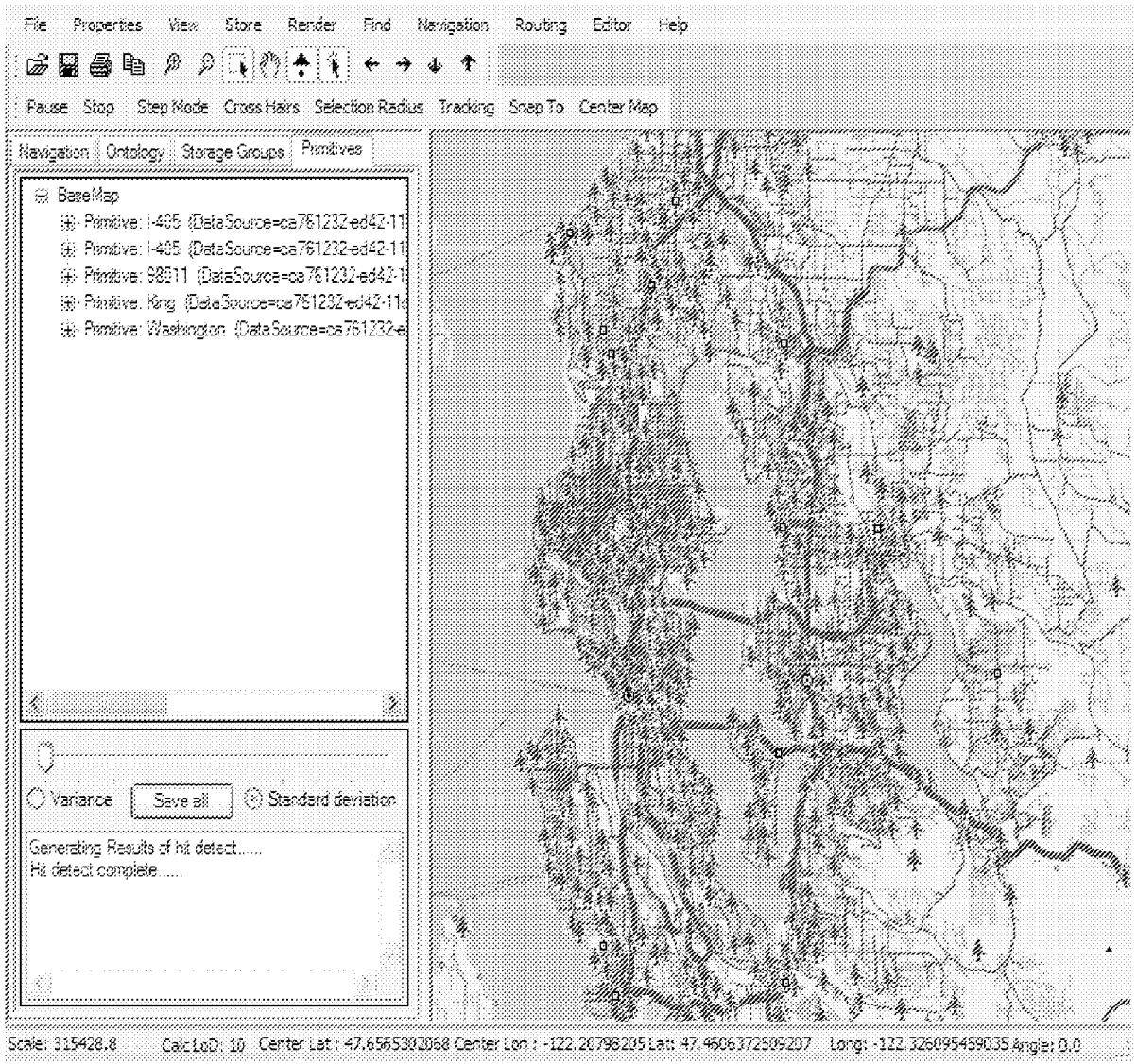
FIG. 7F is a representative display of a predictive model of traffic variance in accordance with at least one aspect of the subject specification.
Figure 7G:
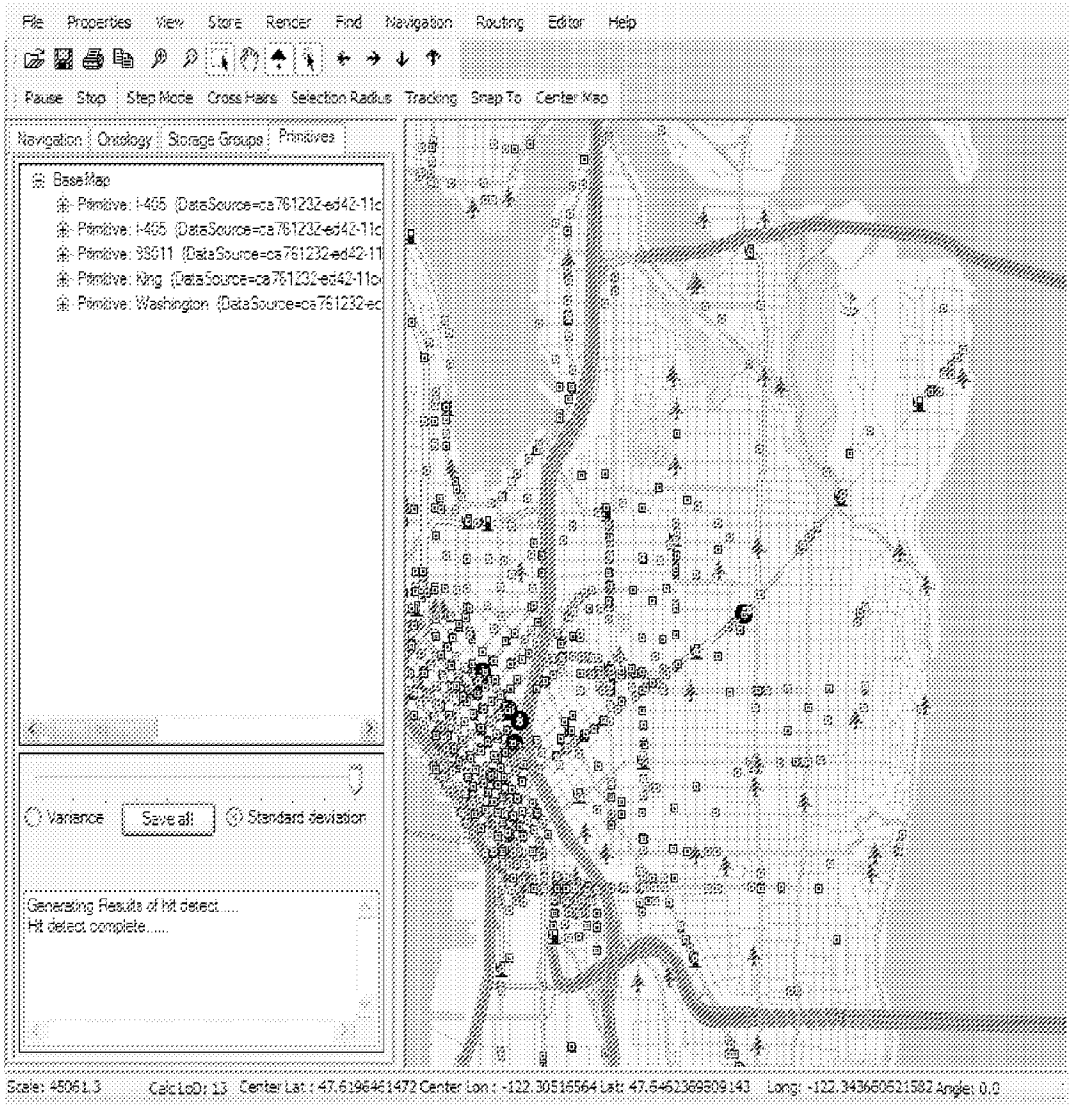
FIG. 7G is a representative display of a predictive model of traffic variance in accordance with at least one aspect of the subject specification.
Figure 7H:
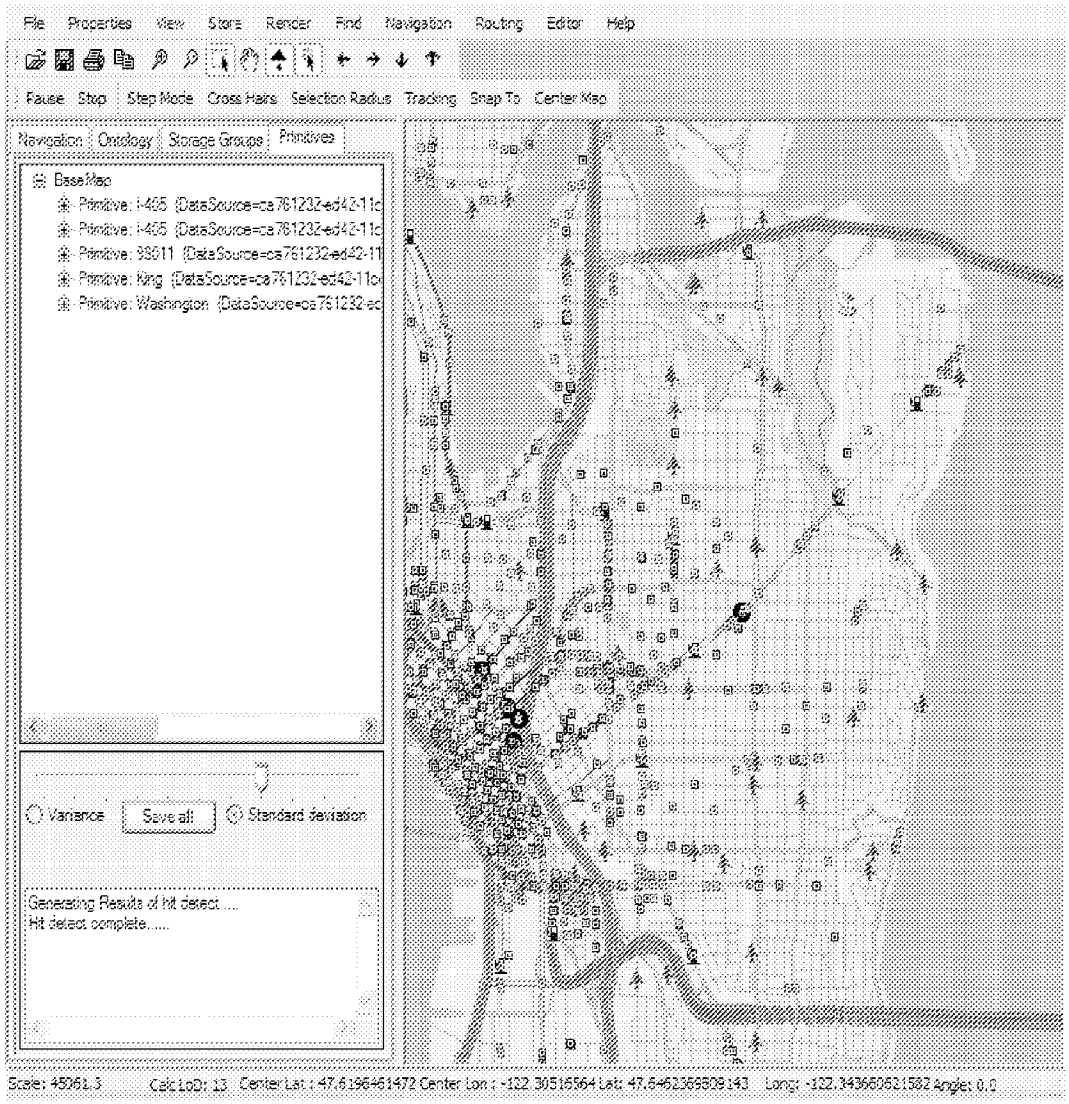
FIG. 7H is a representative display of a predictive model of traffic variance in accordance with at least one aspect of the subject specification.
Figure 7I:
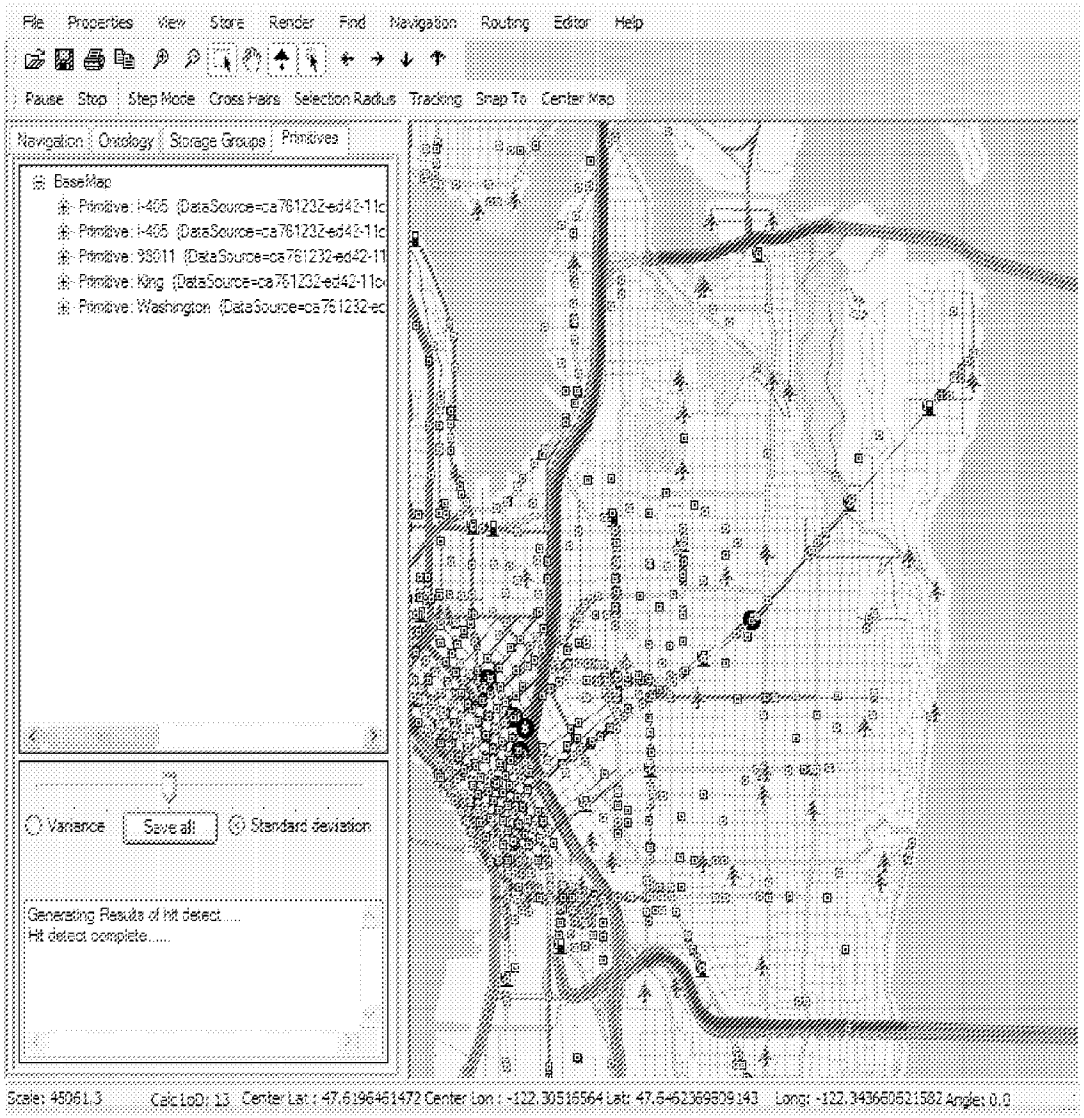
FIG. 7I is a representative display of a predictive model of traffic variance in accordance with at least one aspect of the subject specification.
Figure 7J:
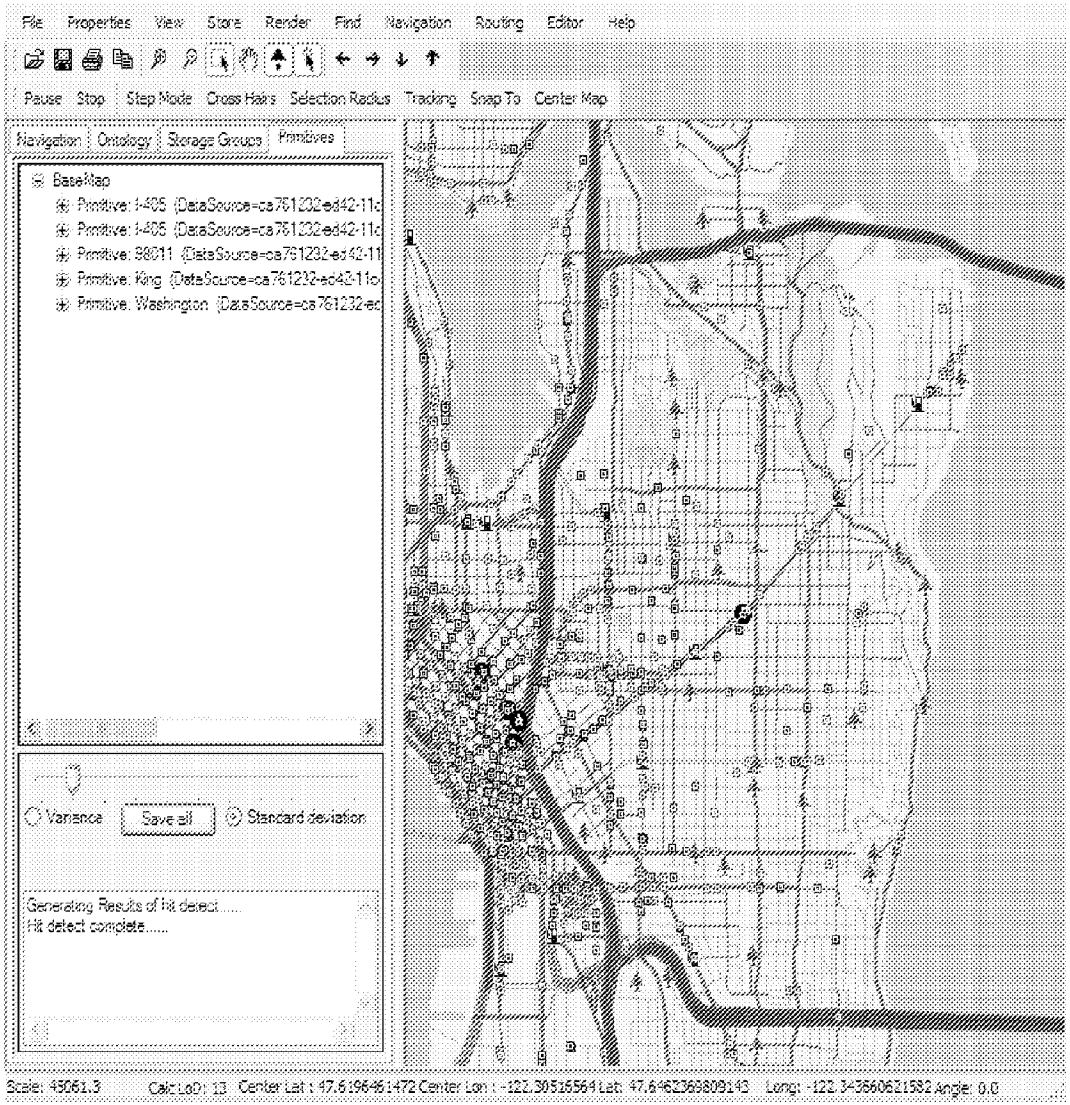
FIG. 7J is a representative display of a predictive model of traffic variance in accordance with at least one aspect of the subject specification.
Figure 7K:
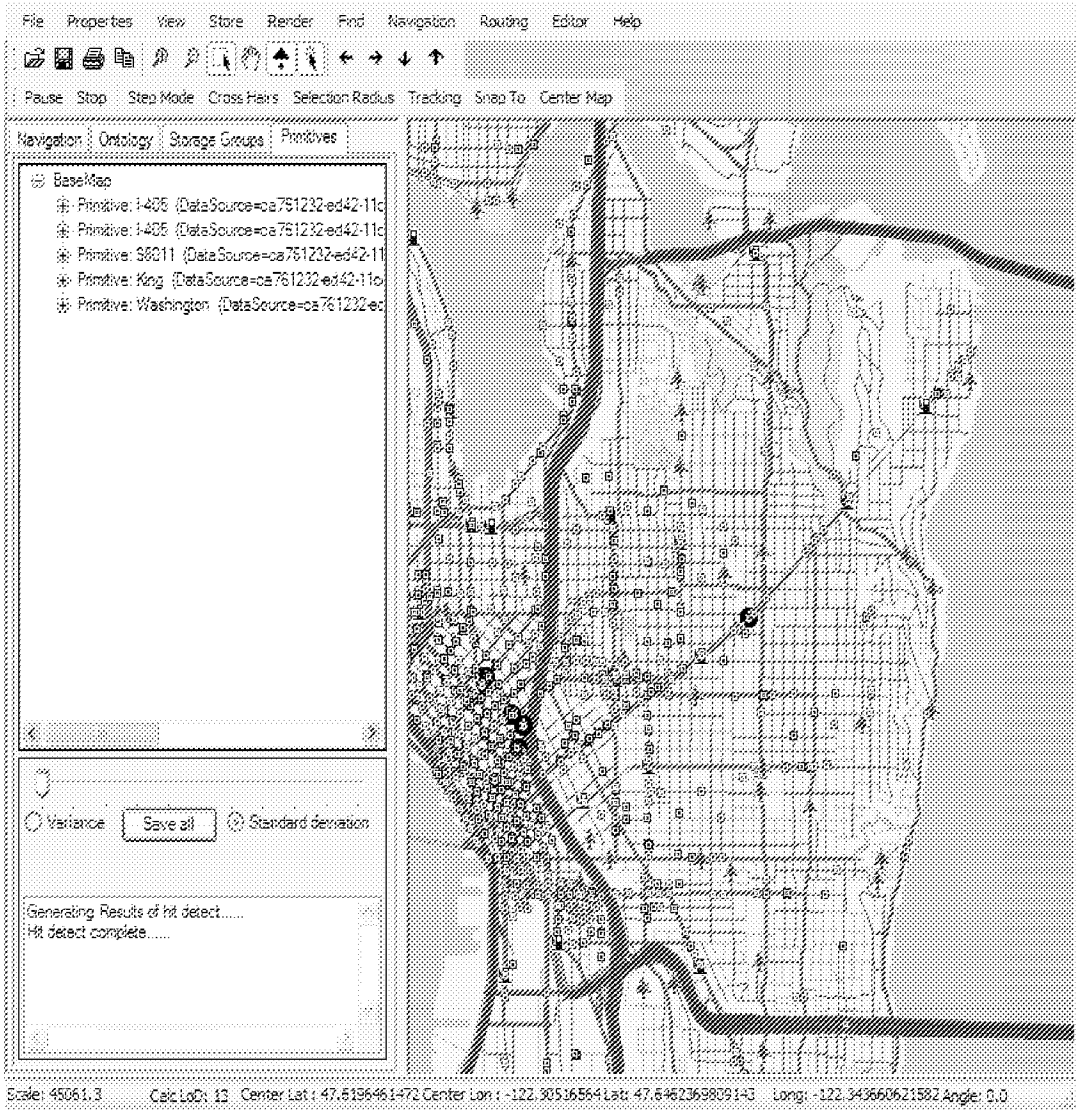
FIG. 7K is a representative display of a predictive model of traffic variance in accordance with at least one aspect of the subject specification.

FIG. 7B to FIG. 7K disclose different presentations of areas with altered variance levels. FIG. 7B to FIG. 7F shows a first presentation of a map with different variances on roads. FIG. 7B has the highest variance while as the figures progress to FIG. 7F, there is the less variance per figure. The same is true for FIG. 7G to FIG. 7K where FIG. 7G has the highest variance while a progression follows to FIG. 7K that has the least variance. Different variance thresholds can be used to create alternative views of a map. FIG. 7B to FIG. 7K respectively illustrate exemplary visual representations of predictive models 706 produced through machine learning such that visualizations are generated for different thresholds on variance that depict most variable and then lesser and lesser variable roads, per speed.

The subject specification discloses a system for valuation of information associated with an arterial flow system that includes means for segmenting a flow system into a plurality of segments that relate to geographical regions and/or means for valuing the plurality of segments of a flow system as a function of utility of sensor data obtained from the plurality of segments. Furthermore, the system can include means for associating the segment values with the sensor data based upon relating location of collection of the sensor data and the geographical regions of the plurality of segments and/or means for filtering the sensor data based at least in part upon the associated the segment values. Moreover, the system can include means for receiving the sensor data, means for associating the segment values with the sensor data based upon relating location of collection of the sensor data and the geographical regions of the plurality of segments, means for analyzing distribution of the sensor data with respect to the associated segment values and/or means for identifying a subset of the plurality of segments based upon the analysis of sensor data and the associated segment values.

Figure 8:
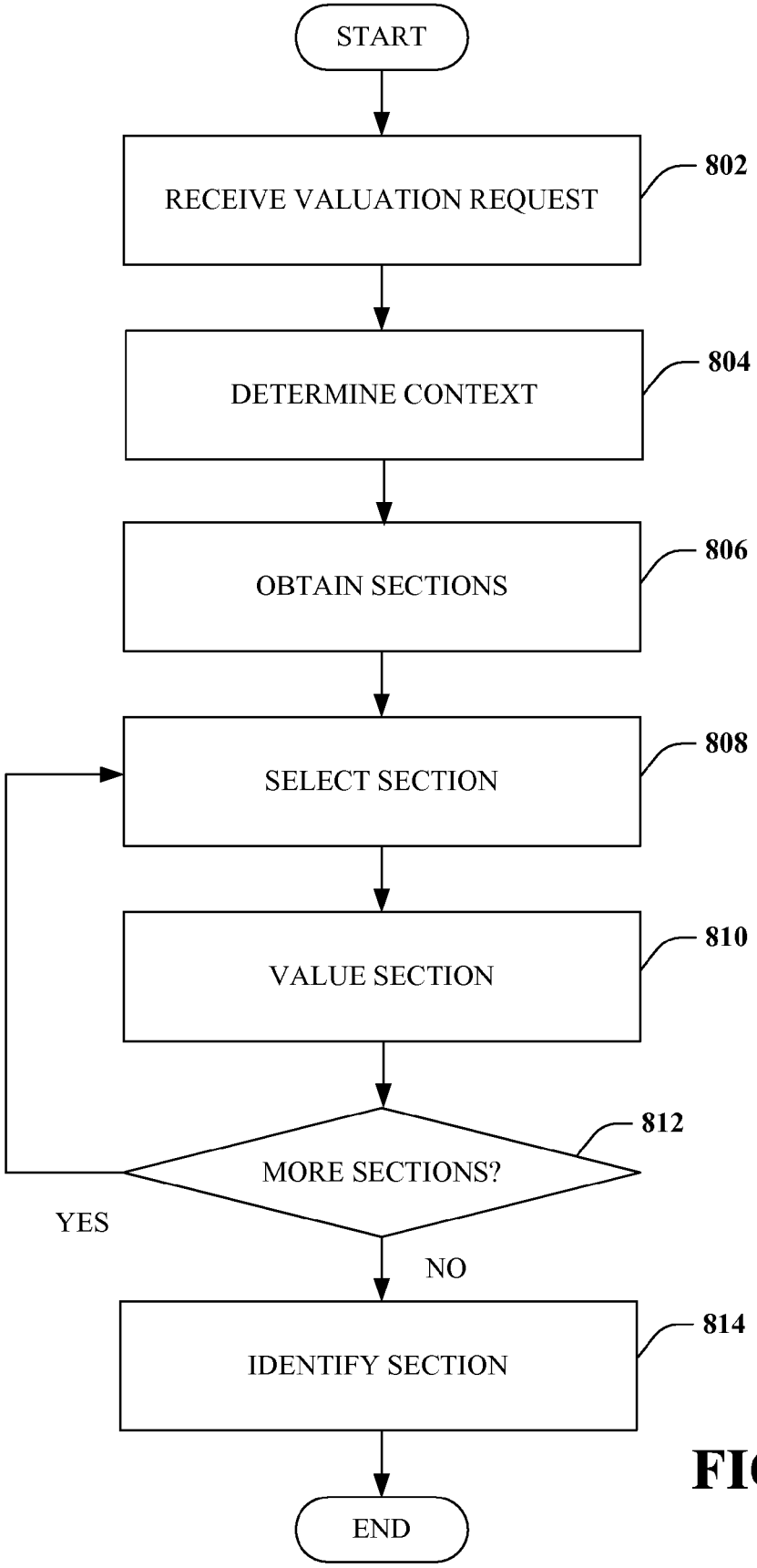
FIG. 8 is a representative flow diagram of a methodology for determining utility values in accordance with the subject matter described herein.

Referring now to FIG. 8, a methodology in accordance with the claimed subject matter will now be described by way of a series of acts. It is to be understood and appreciated that the claimed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the claimed subject matter. Additionally, it should be further appreciated that the methodology disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

Referring specifically to FIG. 8, a methodology for generating utility values for sections of a flow system is illustrated. At reference numeral 802, a request for valuation is received. The request can trigger the valuation process. Alternatively, the valuation process can be triggered periodically or based upon changes to the flow system. At reference numeral 804, context for the flow system can be determined. The valuation request can include contextual information, such that the utility values generated correspond to current context of the flow system. For example, the evaluation request can specify that utility values should be generated based upon traffic flow for the evening rush hour. Alternatively, contextual information can be obtained from one or more data sources (e.g., a website that describes current/forecast weather conditions). Sections or subdivisions of the flow system can be obtained at 806. Sections can be specified using predetermined divisions or based upon the received request.

At reference numeral 808, a section is selected for valuation. A utility value for the section is generated at reference numeral 810. Utility values can be based upon the usefulness of data collected at the section in predicting or detecting heavy congestion. The utility value can be affected by the context. For example, a section corresponding to inbound lanes of a major highway into a downtown area is likely to be useful in detecting heavy congestion during the morning rush hours and less likely to be useful during evening rush hours, when traffic flow is generally reversed. Accordingly, the section corresponding to inbound lanes can have a high utility value in the context of morning rush hours and low utility value in the context of evening rush hours. At reference numeral 812, a determination is made as to whether there are additional sections to process. If yes, the process returns to reference numeral 808, where the next section is selected. If no, the process continues to reference numeral 814, where key sections of the flow system can be identified based upon the relative utility values of the various sections. Key sections are generally those sections with the highest utility values. Identification of the key sections can be useful in determining processing order of sensor data from various sections, as well as in selection or placement of sensors.

Figure 9:
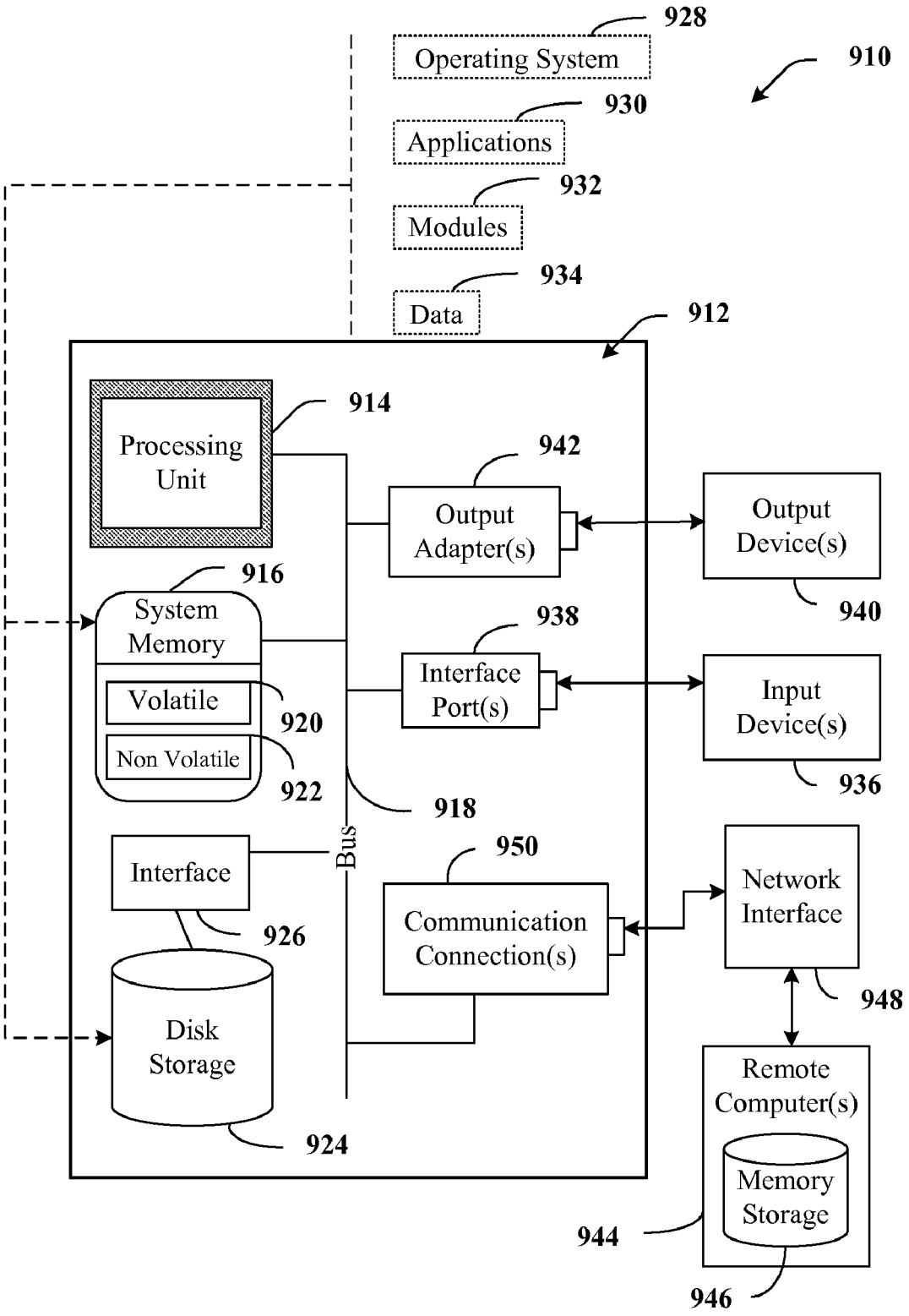
FIG. 9 is a schematic block diagram illustrating a suitable operating environment.

In order to provide additional context for various aspects of the claimed subject matter, FIG. 9 and the following discussion are intended to provide a brief, general description of a suitable operating environment 910 in which various aspects may be implemented. While the claimed subject matter is described in the general context of computer-executable instructions, such as program modules, executed by one or more computers or other devices, those skilled in the art will recognize that the invention can also be implemented in combination with other program modules and/or as a combination of hardware and software.

Generally, however, program modules include routines, programs, objects, components, data structures, etc. that perform particular tasks or implement particular data types. The operating environment 910 is only one example of a suitable operating environment and is not intended to suggest any limitation as to the scope of use or functionality of the features described herein. Other well known computer systems, environments, and/or configurations that may be suitable for use with the claimed subject matter include but are not limited to, personal computers, hand-held or laptop devices, multiprocessor systems, microprocessor-based systems, programmable consumer electronics, network PCs, minicomputers, mainframe computers, distributed computing environments that include the above systems or devices, and the like.

With reference to FIG. 9, an exemplary environment 910 that can be employed in connection with monitoring of flow systems includes a computer 912. The computer 912 includes a processing unit 914, a system memory 916, and a system bus 918. The system bus 918 couples system components including, but not limited to, the system memory 916 to the processing unit 914. The processing unit 914 can be any of various available processors. Dual microprocessors and other multiprocessor architectures also can be employed as the processing unit 914.

The system bus 918 can be any of several types of bus structure(s) including the memory bus or memory controller, a peripheral bus or external bus, and/or a local bus using any variety of available bus architectures including, but not limited to, 8-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI). The system memory 916 includes volatile memory 920 and nonvolatile memory 922. The basic input/output system (BIOS), containing the basic routines to transfer information between elements within the computer 912, such as during start-up, is stored in nonvolatile memory 922. By way of illustration, and not limitation, nonvolatile memory 922 can include read only memory (ROM), programmable ROM (PROM), electrically programmable ROM (EPROM), electrically erasable ROM (EEPROM), or flash memory. Volatile memory 920 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 912 also includes removable/nonremovable, volatile/nonvolatile computer storage media. FIG. 9 illustrates, for example a disk storage 924. Disk storage 924 includes, but is not limited to, devices like a magnetic disk drive, floppy disk drive, tape drive, Jaz drive, Zip drive, LS-100 drive, flash memory card, or memory stick. In addition, disk storage 924 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). For instance, a DVD-ROM drive can be employed in connection with reading video content from a DVD. To facilitate connection of the disk storage devices 924 to the system bus 918, a removable or nonremovable interface is typically used such as interface 926.

It is to be appreciated that FIG. 9 describes software that acts as an intermediary between users and the basic computer resources described in suitable operating environment 910. Such software includes an operating system 928. Operating system 928, which can be stored on disk storage 924, acts to control and allocate resources of the computer system 912. System applications 930 take advantage of the management of resources by operating system 928 through program modules 932 and program data 934 stored either in system memory 916 or on disk storage 924. It is to be appreciated that the subject invention can be implemented with various operating systems or combinations of operating systems.

A user enters commands or information into the computer 912 through input device(s) 936. Input devices 936 include, but are not limited to, a pointing device such as a mouse, trackball, stylus, touch pad, touch screen, steering wheel buttons, keyboard, microphone, joystick, game pad, satellite dish, scanner, TV tuner card, digital camera, digital video camera, web camera, remote control, and the like. These and other input devices connect to the processing unit 914 through the system bus 918 via interface port(s) 938. Interface port(s) 938 include, for example, a serial port, a parallel port, a game port, and a universal serial bus (USB). Output device(s) 940 use some of the same type of ports as input device(s) 936. Thus, for example, a USB port may be used to provide input to computer 912, and to output information from computer 912 to an output device 940. Output adapter 942 is provided to illustrate that there are some output devices 940 like monitors, in-dash displays, speakers, and printers among other output devices 940 that require special adapters. The output adapters 942 include, by way of illustration and not limitation, video and sound cards that provide a means of connection between the output device 940 and the system bus 918. It should be noted that other devices and/or systems of devices provide both input and output capabilities such as remote computer(s) 944.

Computer 912 can operate in a networked environment using logical connections to one or more remote computers, such as remote computer(s) 944. The remote computer(s) 944 can be a personal computer, a server, a router, a network PC, a workstation, a microprocessor based appliance, a peer device or other common network node and the like, and typically includes many or all of the elements described relative to computer 912. For purposes of brevity, only a memory storage device 946 is illustrated with remote computer(s) 944. Remote computer(s) 944 is logically connected to computer 912 through a network interface 948 and then physically connected via communication connection 950. Network interface 948 encompasses communication networks such as local-area networks (LAN) and wide-area networks (WAN). LAN technologies include Fiber Distributed Data Interface (FDDI), Copper Distributed Data Interface (CDDI), Ethernet/IEEE 802.3, Wireless Lan (e.g., 802.11 and WiMax) Token Ring/IEEE 802.5 and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 950 refers to the hardware/software employed to connect the network interface 948 to the bus 918. While communication connection 950 is shown for illustrative clarity inside computer 912, it can also be external to computer 912. The hardware/software necessary for connection to the network interface 948 includes, for exemplary purposes only, internal and external technologies such as, modems including regular telephone grade modems, cable modems and DSL modems, ISDN adapters, and Ethernet cards.

Figure 10:
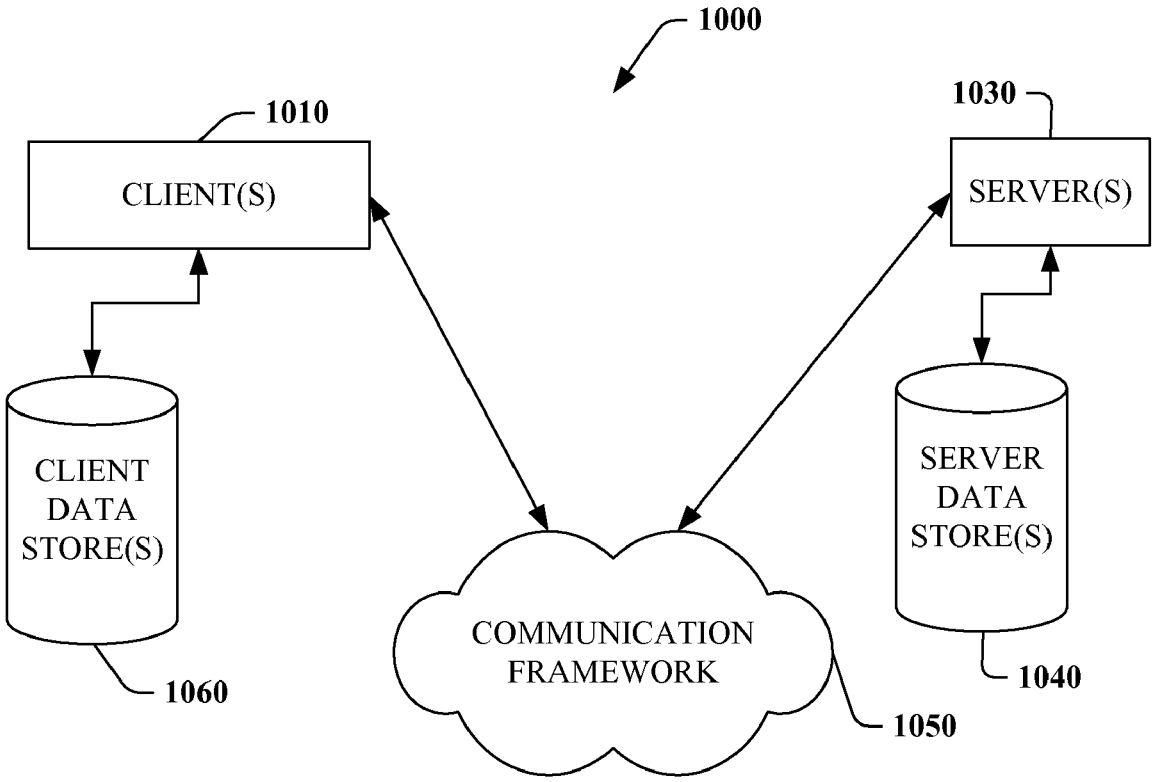
FIG. 10 is a schematic block diagram of a sample-computing environment.

FIG. 10 is a schematic block diagram of a sample-computing environment 1000 with which the claimed subject matter can interact. The system 1000 includes one or more client(s) 1010. The client(s) 1010 can be hardware and/or software (e.g., threads, processes, computing devices). The system 1000 also includes one or more server(s) 1030. The server(s) 1030 can also be hardware and/or software (e.g., threads, processes, computing devices). The servers 1030 can house threads to perform transformations by employing the claimed subject matter, for example. One possible communication between a client 1010 and a server 1030 can be in the form of a data packet adapted to be transmitted between two or more computer processes. The system 1000 includes a communication framework 1050 that can be employed to facilitate communications between the client(s) 1010 and the server(s) 1030. The client(s) 1010 are operably connected to one or more client data store(s) 1060 that can be employed to store information local to the client(s) 1010. Similarly, the server(s) 1030 are operably connected to one or more server data store(s) 1040 that can be employed to store information local to the server(s) 1030.

What has been described above includes examples of the claimed subject matter. It is, of course, not possible to describe every conceivable combination of components or methodologies for purposes of describing such subject matter, but one of ordinary skill in the art may recognize that many further combinations and permutations are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A computer-implemented system for valuation of relative utility of data associated with an arterial flow system, comprising:

at least one computer adapted to implement components comprising:

a flow system representation that describes probable flow for the flow system;

a valuation component that generates a utility value associated with a plurality of sensors, each sensor sensing flow in a respective section of a plurality of sections of the flow system based at least in part upon the flow system representation, the utility value is generated as a function of historical data and indicates a utility of sensor data associated with the section in detecting congestion for the flow system; and a filter component that selectively communicates sensor data to at least one mobile device comprising a route planning system, the communicated sensor data comprising data from a subset of the plurality of sensors based on the utility value, the subset comprising multiple sensors selected by comparing utility values for sensors of the plurality of sensors to a threshold.

2. The system of claim 1, further comprising:

a context analyzer component that analyzes contextual data for the flow system, the utility value is based at least in part upon the contextual data.

3. The system of claim 1, further comprising:

a section component that specifies the plurality of sections based upon at least one of geographical regions and sensor positions for the flow system; and a data store component that maintains the plurality of sections.

4. The system of claim 1, further comprising a placement component that determines placement of at least a portion of the plurality of sensors based at least in part upon a projection of utility values associated with the portion.

5. The system of claim 1, further comprising:

a sensor interface component that obtains the sensor data as collected by the plurality of sensors; and a context analyzer component that analyzes contextual data associated with the plurality of sensors, the utility value is based at least in part upon the contextual data.

6. The system of claim 5, further comprising:

a user context component that adjusts the utility value based at least in part upon a user profile that includes at least one of user preferences and frequent user routes.

7. The system of claim 1, wherein the filter component selects the subset to include sensors of the plurality of sensors having a utility value above the threshold.

8. The system of claim 1, further comprising:

a bottleneck identification component that identifies a location of a probable bottleneck;

a bottleneck indicator component that identifies a bottleneck indicator section indicative of a bottleneck; and a route generating component that generates an alternate route based upon the probable bottleneck and the bottleneck indicator section.

9. The system of claim 1, further comprising a sensor analysis component that generates sensor analysis information by analyzing distribution of the sensor data in comparison to the utility value; and an output component that provides the sensor analysis information to an operator.

10. A method for determining utility of information for an arterial flow system, comprising:

with at least one processor:

receiving a request to generate valuations for the flow system;

obtaining a set of segments that define the flow system;

determining utility values of one or more segments of the set of segments, the utility values are a function of variances of sensor data associated with the one or more segments for monitoring the flow system, selecting sensor data to provide to a remote route planning system based on the determined utility values;

receiving from the remote route planning system indications of limits on an amount of sensor data to provide to the remote route planning system; and selecting sensor data to provide to the remote route planning system comprises selecting sensor data in accordance with the limits.

11. The method of claim 10, further comprising:

generating a prioritized list of the set of segments based at least in part upon the utility values.

12. The method of claim 10, wherein:

the method further comprises:

receiving the sensor data collected by a plurality of sensors;

identifying correspondence between the sensor data and the set of segments; and selecting sensor data to provide to a remote route planning system based on the determined utility values comprises filtering the sensor data based at least in part upon the relative utility values of the set of segments corresponding to the sensor data.

13. The method of claim 12, further comprising:

analyzing context associated with the sensor data; and adjusting the utility values corresponding to the sensor data as a function of the context.

14. The method of claim 10, wherein selecting sensor data to provide to a remote route planning system based on the determined utility values comprises:

receiving the sensor data for the flow system;

analyzing a distribution of sensor data corresponding to the set of segments with regard to the utility values of the one or more segments;

identifying a subset of the set of segments based upon the analysis of the sensor data and the utility values; and providing the identified subset of segments to an operator.

15. The method of claim 10, further comprising:

identifying a probable bottleneck in the flow system;

identifying one or more bottleneck indicative segments corresponding to sensor data indicative of the bottleneck;

generating a route that includes one or more alternate routes, selection of the one or more alternate routes is based at least in part upon the one or more bottleneck indicative segments; and providing the route to a user.

16. A method for determining utility of information for an arterial flow system, comprising:

with at least one processor:

receiving a request to generate valuations for the flow system;

obtaining a set of segments that define the flow system;

determining utility values of one or more segments of the set of segments, the utility values are a function of variances of sensor data associated with the one or more segments for monitoring the flow system, selecting sensor data to provide to a remote route planning system based on the determined utility values, the selecting comprising:

receiving the sensor data for the flow system;

analyzing a distribution of sensor data corresponding to the set of segments with regard to the utility values of the one or more segments;

identifying a subset of the set of segments based upon the analysis of the sensor data and the utility values; and providing the identified subset of segments to an operator.

17. The method of claim 16, further comprising:

generating a prioritized list of the set of segments based at least in part upon the utility values.

18. The method of claim 16, wherein:

the method further comprises:

receiving the sensor data collected by a plurality of sensors;

identifying correspondence between the sensor data and the set of segments; and selecting sensor data to provide to a remote route planning system based on the determined utility values comprises filtering the sensor data based at least in part upon the relative utility values of the set of segments corresponding to the sensor data.

19. The method of claim 18, further comprising:

analyzing context associated with the sensor data; and adjusting the utility values corresponding to the sensor data as a function of the context.

20. The method of claim 16, further comprising:

identifying a probable bottleneck in the flow system;

identifying one or more bottleneck indicative segments corresponding to sensor data indicative of the bottleneck;

generating a route that includes one or more alternate routes, selection of the one or more alternate routes is based at least in part upon the one or more bottleneck indicative segments; and providing the route to a user.

* * * * *